US011324997B2

(12) United States Patent
Panes

(10) Patent No.: US 11,324,997 B2
(45) **Date of Patent: *May 10, 2022**

(54) ABDOMINAL AND CORE EXERCISER DEVICE

(71) Applicant: Stealth Body Fitness, LLC, Bradenton, FL (US)

(72) Inventor: Howard Panes, Bradenton, FL (US)

(73) Assignee: Stealth Body Fitness, LLC, Bradenton, FL (US)

( * ) Notice: Subject to any disclaimer, the term of this patent is extended or adjusted under 35 U.S.C. 154(b) by 75 days.

This patent is subject to a terminal disclaimer.

(21) Appl. No.: 16/775,169

(22) Filed: Jan. 28, 2020

(65) Prior Publication Data

US 2020/0164245 A1 May 28, 2020

Related U.S. Application Data

(63) Continuation of application No. 15/497,111, filed on Apr. 25, 2017, now Pat. No. 10,583,321.

(Continued)

(51) Int. Cl.

*A63B 23/02* (2006.01)
*A63B 71/06* (2006.01)

(Continued)

(52) U.S. Cl.

CPC ..... *A63B 23/0211* (2013.01); *A63B 21/0023* (2013.01); *A63B 21/023* (2013.01); *A63B 21/068* (2013.01); *A63B 21/4033* (2015.10); *A63B 22/18* (2013.01); *A63B 23/0216* (2013.01); *A63B 23/0227* (2013.01); *A63B 23/0244* (2013.01); *A63B 23/1236* (2013.01); *A63B 71/0622* (2013.01); *A63B 21/4035* (2015.10); *A63B 2071/0072* (2013.01); *A63B 2071/065* (2013.01);

(Continued)

(58) Field of Classification Search

CPC ..... A63B 21/068; A63B 21/4033; A63B 21/4035; A63B 22/18; A63B 23/0211; A63B 23/0216; A63B 23/1236; A63B 23/0244; A63B 23/0227

See application file for complete search history.

(56) References Cited

U.S. PATENT DOCUMENTS 5,062,629 A 11/1991 Vaughan
7,156,786 B1 1/2007 Palmer (Continued)

FOREIGN PATENT DOCUMENTS

AT 12127 U1 11/2011
CN 204767193 U 11/2015

(Continued)

OTHER PUBLICATIONS

Russian Office Action dated Aug. 17, 2020, from application No. 2018140482.

(Continued)

*Primary Examiner* — Megan Anderson
(74) *Attorney, Agent, or Firm* — Foley & Lardner LLP

(57) ABSTRACT

There is provided a plank exercise device including a support portion adapted to receive arms or hands of a person and adapted to receive a display device, a destabilizer connected to the support portion, and a stationary base adapted to hold the destabilizer.

18 Claims, 23 Drawing Sheets

Related U.S. Application Data

(60) Provisional application No. 62/327,343, filed on Apr. 25, 2016.

(51) Int. Cl.

| | |
|---|---|
| ***A63B 21/00*** | (2006.01) |
| ***A63B 22/18*** | (2006.01) |
| ***A63B 21/068*** | (2006.01) |
| ***A63B 21/02*** | (2006.01) |
| ***A63B 23/12*** | (2006.01) |
| ***A63B 21/002*** | (2006.01) |
| *A63B 71/00* | (2006.01) |

(52) U.S. Cl.

CPC ..... *A63B 2071/0652* (2013.01); *A63B 2071/0694* (2013.01); *A63B 2208/0295* (2013.01); *A63B 2220/40* (2013.01); *A63B 2220/52* (2013.01); *A63B 2225/20* (2013.01); *A63B 2225/50* (2013.01); *A63B 2225/685* (2013.01)

(56) References Cited

U.S. PATENT DOCUMENTS

| | | | | |
|---|---|---|---|---|
| 7,288,055 | B2 | 10/2007 | Blaum | |
| 7,479,097 | B2 | 1/2009 | Rosborough et al. | |
| 7,481,753 | B2 | 1/2009 | James et al. | |
| 7,896,789 | B2 | 3/2011 | Hinton et al. | |
| 8,088,052 | B1 | 1/2012 | Sprague | |
| 8,118,718 | B2 | 2/2012 | Brodess et al. | |
| 8,986,179 | B2 | 3/2015 | Cares | |
| 9,079,072 | B2 | 7/2015 | Agostini | |
| 9,327,155 | B2 | 5/2016 | Doyle | |
| 10,099,086 | B2 | 10/2018 | Polinsky | |
| 2003/0125173 | A1 | 7/2003 | Fan et al. | |
| 2003/0181300 | A1 | 9/2003 | Chin | |
| 2003/0195096 | A1 | 10/2003 | Hecox et al. | |
| 2006/0281602 | A1 | 12/2006 | Dalen | |
| 2007/0184951 | A1 | 8/2007 | James et al. | |
| 2007/0184953 | A1 | 8/2007 | Luberski et al. | |
| 2007/0207906 | A1 | 9/2007 | Blaum | |
| 2007/0298947 | A1 | 12/2007 | Eksteen | |
| 2010/0240495 | A1 | 9/2010 | Law et al. | |
| 2011/0065550 | A1 | 3/2011 | Cohn et al. | |
| 2011/0143896 | A1 | 6/2011 | Senegal | |
| 2011/0212810 | A1 | 9/2011 | Jeka et al. | |
| 2012/0010058 | A1 | 1/2012 | Sprague | |
| 2014/0011649 | A1 | 1/2014 | Carney | |
| 2014/0162859 | A1* | 6/2014 | Cheng | A63B 21/05 482/142 |
| 2014/0194265 | A1 | 7/2014 | Torres | |
| 2015/0238793 | A1 | 8/2015 | Kramer et al. | |
| 2015/0238795 | A1 | 8/2015 | Domesick | |
| 2016/0144229 | A1 | 5/2016 | Aluru et al. | |
| 2016/0199699 | A1 | 7/2016 | Klassen | |
| 2016/0220862 | A1 | 8/2016 | Johnson | |
| 2016/0263425 | A1 | 9/2016 | Carney | |
| 2016/0271438 | A1 | 9/2016 | Weisz et al. | |
| 2017/0043219 | A1 | 2/2017 | Polinsky | |
| 2017/0095694 | A1 | 4/2017 | Polinsky | |

FOREIGN PATENT DOCUMENTS

| | | | |
|---|---|---|---|
| EP | 2 982 420 | A1 | 2/2016 |
| KR | 101568617 | | 11/2015 |
| KR | 20160021020 | A | 2/2016 |
| RU | 2276571 | C1 | 5/2006 |
| RU | 73793 | | 6/2008 |
| RU | 107063 | U1 | 8/2011 |
| WO | WO-03/105969 | A1 | 12/2003 |
| WO | WO-2005/011818 | A1 | 2/2005 |
| WO | WO-2006/059013 | A1 | 6/2006 |
| WO | WO-2008/014533 | A1 | 2/2008 |
| WO | WO-2015/130177 | A1 | 9/2015 |

OTHER PUBLICATIONS

Russian Search Report dated Aug. 17, 2020, from application No. 2018140482.

Chinese Office Action dated Feb. 26, 2020, from application No. 201780025625.5.

Extended European Search Report dated Mar. 4, 2020, from application No. 17790296.2.

International Preliminary Report on Patentability dated Nov. 8, 2018, from application No. PCT/US2017/029485.

International Search Report and Written Opinion dated Aug. 17, 2017, from application No. PCT/US2017/029485.

Non-Final Office Action dated Dec. 31, 2018, from U.S. Appl. No. 15/497,111.

Notice of Allowance dated Oct. 30, 2019, from U.S. Appl. No. 15/497,111.

Partial Supplementary European Search Report dated Nov. 29, 2019, from application No. 17790296.2.

Korean Office Action dated May 25, 2021, from application No. 10-2018-7033478.

European Office Action dated Jan. 29, 2021, from application No. 17790296.2.

Japanese Office Action dated Feb. 9, 2021, from application No. 2018-555624.

* cited by examiner

ABDOMINAL AND CORE EXERCISER DEVICE

CROSS-REFERENCE TO RELATED APPLICATION

This application is a continuation of U.S. application Ser. No. 15/497,111, filed Apr. 25, 2017, which claims the benefit of and priority to U.S. provisional patent application Ser. No. 62/327,343, filed Apr. 25, 2016, the contents of each of which are incorporated herein by reference in their entireties.

FIELD

Embodiments disclosed herein relate generally to exercise devices.

BACKGROUND

Various types of exercises have been created for exercising particular muscles of the human body. For example, one relatively popular exercise for exercising the muscles of the abdomen and core is known as a plank. During such an exercise, a person places his or her body in a prone position or pushup position with legs straight or bent and having toes or knees touching a support surface while supporting the upper body with the hands (pushup position) or the forearms (plank position) on a support surface. The idea is to hold the body in an erect horizontal position using the core muscles to stabilize the body.

Variations of this exercise include using one arm or hand to support the body in a sideways position (known as the "side plank") and the reverse plank where the body is flipped upside down with the arms facing the back of the user and the heels of the body contacting the support surface while the user is facing upwards.

The plank exercise is sometimes performed on a support surface such as a floor and sometimes on a towel or exercise mat to prevent sliding. The plank exercise in the past has been performed on a wobble board type device. When performing a plank on a wobble board on a floor, however, if the user tilts from side to side, the wobble board tends to slide across the floor, forcing the user to have to move his or her feet to stay properly aligned with the wobble board.

SUMMARY

According to some embodiments, there is provided a plank exercise device including a support portion adapted to receive arms or hands of a person and adapted to receive a display device, a destabilizer connected to the support portion, and a stationary base adapted to hold the destabilizer. In some embodiments, the plank exercise device is further configured to include a plurality of load sensors mounted to the base that sense forces and are in communication with a microcontroller wherein the microcontroller is capable of communicating information to the display device. In some embodiments, the destabilizer includes a pivot ball mounted to a collar. In some embodiments, the destabilizer includes a ball bearing turntable. In some embodiments the destabilizer is a spring. In some embodiments, the destabilizer includes a plurality of pivot balls. In some embodiments the destabilizer is mounted between four percent to 12 percent off-center of the center line of the support portion. In some embodiments, the plank exercise device is further configured to include a plurality of stops connected to the underside of the support portion. In some embodiments, the support portion is generally trapezoidal in shape.

According to some embodiments, there is provided a core exercise device including a generally trapezoidal shaped padded portion adapted to receive a smart device, a support portion connected to the padded portion, a pivot ball connected to the support portion off-center from the center line of the support portion, and a stationary base in which the pivot ball is mounted. In some embodiments, the core exercise device further includes a plurality of stops connected to the underside of the support portion. In some embodiments, the core exercise device further includes a plurality of load sensors mounted to the bottom of the base that sense forces and are in communication with a microcontroller wherein the microcontroller is capable of communicating information to the display device.

According to some embodiments, there is provided a plank exercise device including a generally trapezoidal shaped support portion adapted to receive arms or hands of a person and adapted to receive a display device, a destabilizer connected to the support portion wherein the destabilizer is mounted between four percent to 12 percent off-center of the center line of the support portion, a stationary base adapted to hold the destabilizer, and a plurality of load sensors mounted to the base that sense forces and are in communication with a microcontroller wherein the microcontroller is capable of communicating information to the display device. In some embodiments, the destabilizer includes a pivot ball mounted to a collar. In some embodiments, the pivot ball is made of nylon. In some embodiments, the pivot ball is made of stainless steel. In some embodiments, the destabilizer includes a ball bearing turntable. In some embodiments, the destabilizer includes a spring. In some embodiments, the destabilizer includes a plurality of pivot balls. In some embodiments, the plank exercise device further includes a plurality of stops connected to the underside of the support portion.

In some embodiments, the exercise device allows for communication with a smart device, such as a smart phone having at least one accelerometer, to allow for monitoring the movement of the exercise device.

In some embodiments, the exercise device includes a support portion adapted to receive arms or hands of a person and wherein the support portion can tilt in a side tilting position throughout the entire range of 0 degrees to 35 degrees, a destabilizer connected to the support portion, and a stationary base adapted to hold the destabilizer. In some embodiments, the exercise device further allows the support portion to tilt forward throughout the entire range of 0 degrees to 19 degrees. In some embodiments, the exercise device further allows the support portion to tilt backward throughout the entire range of 0 degrees to 27 degrees.

A method of playing a game on an exercise device includes the steps of placing a user's arms or hands on a support portion of the exercise device adapted to receive arms or hands of a person and wherein the support portion can tilt in a side tilting position, a forward tilting position, and a backward tilting position, executing a game on a display device, and tilting the support portion in response to a screen displayed on the display device.

DETAILED DESCRIPTION

Figure 1A:
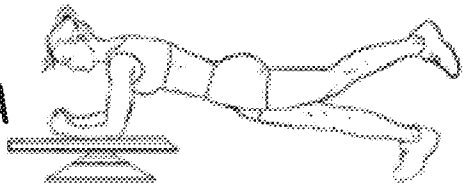
FIGS. 1A-1G illustrate variations of the plank exercise that may be performed with various embodiments.
Figure 1B:
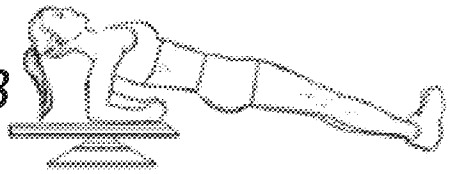
Figure 1C:
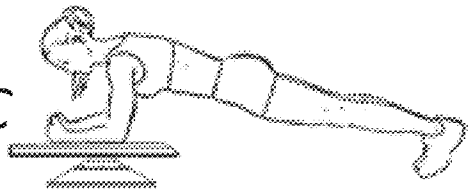
Figure 1D:
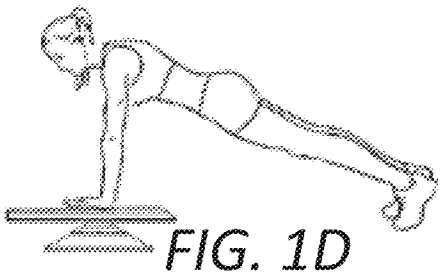
Figure 1E:
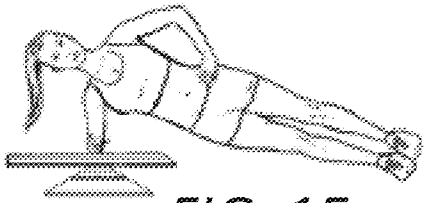
Figure 1F:
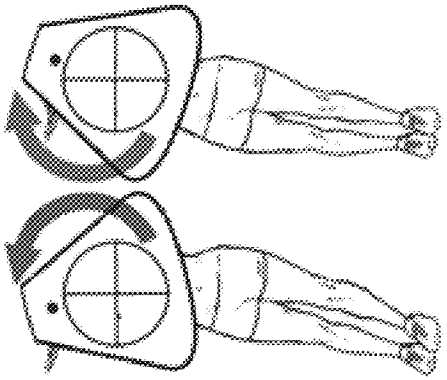
Figure 1G:
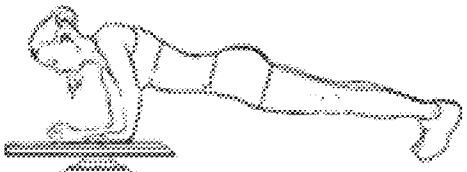

FIGS. 1A-1G show examples of variations of the traditional plank exercise in which a person is in the prone position with legs straight and having toes on a floor or other support surface while supporting the upper body with the forearms on some embodiments of the exercise device while holding the body in an stable horizontal position using the core muscles to stabilize the body. FIG. 1A shows the exercise performed on one foot. FIG. 1B shows the exercise performed in reverse with the person's head facing away from an embodiment of the exercise device. FIG. 1C shows a version of the traditional plank exercise performed on an embodiment of the exercise device. FIG. 1D shows the push up plank exercise performed on an embodiment of the exercise device. FIG. 1E shows a side plank exercise performed on an embodiment of the exercise device. FIG. 1F shows a twisting plank exercise performed on an embodiment of the exercise device. In the twisting plank exercise, an embodiment of the exercise device rotates to the right and left to increase activation of core muscles. FIG. 1G shows a one arm plank exercise performed on an embodiment of the exercise device.

Figure 2:
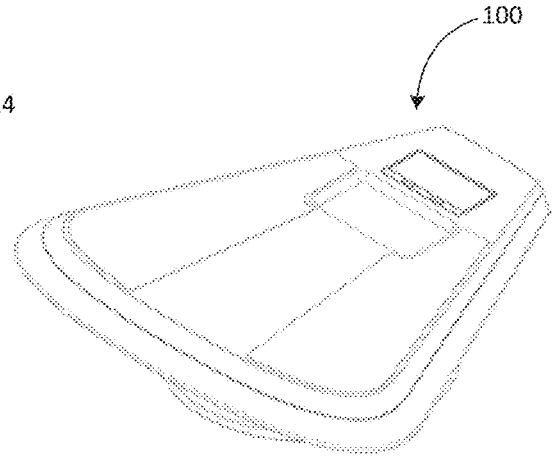
FIG. 2 illustrates a perspective view of a ball joint embodiment.

Referring now to FIG. 2, a preferred ball joint embodiment of the assembled exercise device 100 is shown.

Figure 3:
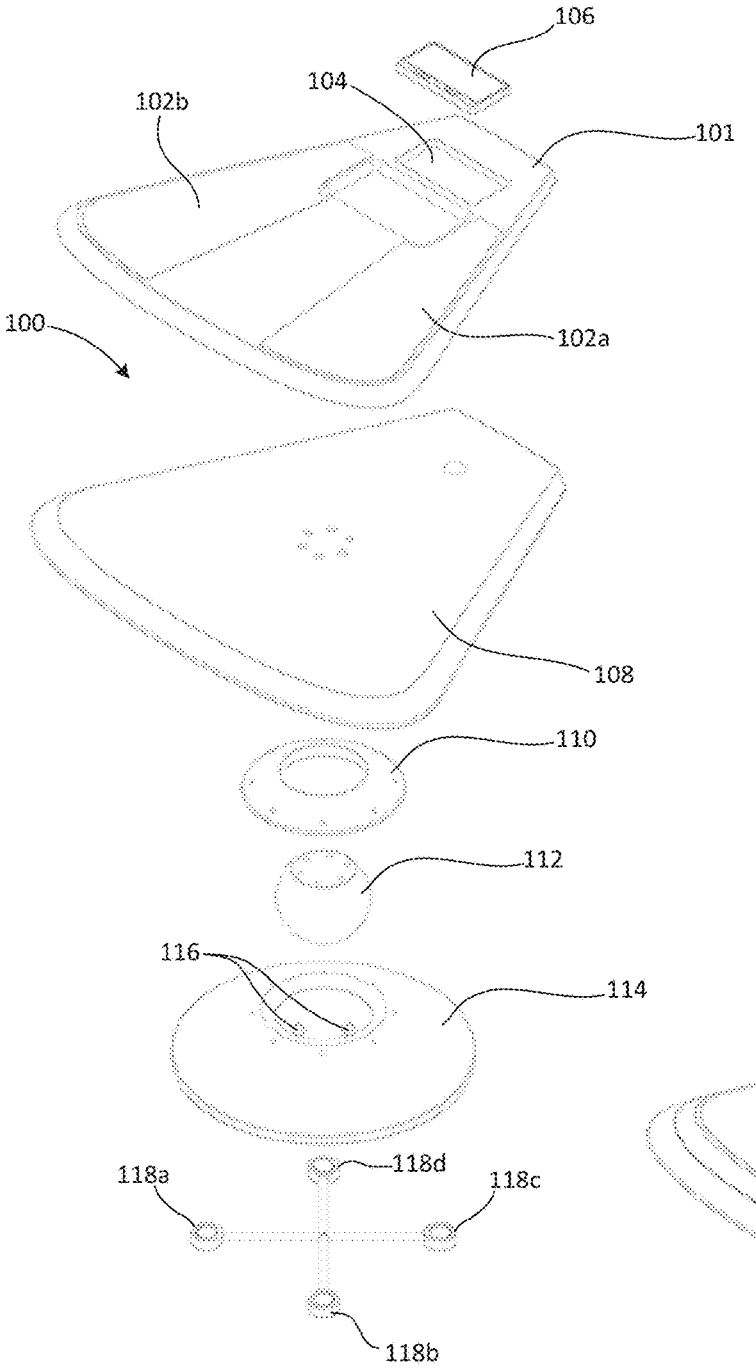
FIG. 3 illustrates an exploded view of components of the embodiment of FIG. 2.

Referring now to FIG. 3, an exploded view of the exercise device 100 is shown. In some embodiments, the components include a padded portion 101, with padded sections 102*a*, 102*b* adapted to receive the arms or hands of a person performing a plank exercise. In some embodiments, padded portion 101 defines a recessed section 104 having a recessed area adapted to receive or hold a smart device 106 such as a smart phone. The padded portion 101 may be made of any suitable material that provides adequate comfort and durability, including without limitation foam, felt, polyethylene foams, or other suitable materials. In some embodiments, the padded portion 101 is mounted to a support portion 108 adapted to support the padded portion 101 and which supports the body weight of a person performing a plank exercise. In some embodiments, the support portion 108 may define a recessed section 104 having a recessed area adapted to receive or hold a smart device 106 such as a smart phone or other portable display device. The support portion 108 may be made of any suitably rigid material, including without limitation, wood, plastic, metal, or other suitable materials. In some embodiments, the support portion 108 and the padded portion 101 are generally trapezoidal in shape to reflect typical placement of a user's arms or hands on the support portion 108 and padded portion 101.

In some embodiments, the support portion 108 is connected via a collar 110 to a destabilizer comprising a pivotal ball 112 mounted within the collar 110, which pivot ball 112 in turn connects to a base 114 adapted to hold the pivotal ball 112. In some embodiments the base 114 is stationary and does not move relative to a support surface. This arrangement of parts allows for freedom of movement like a ball and socket joint and the pivotal ball 112 provides an unstable support. In some embodiments, the ball and socket joint provides for low friction motion by means of self-lubricating materials or the use of ball bearings 116. In some embodiments, the pivotal ball 112 is made of nylon or Teflon material to ensure that it moves with low friction and glides easily. In some embodiments, the pivotal ball 112 is made of stainless steel. Placing the pivotal ball 112 in a base 114 prevents the exercise device 100 from sliding across the floor when the user tilts the exercise device 100 from side to side. In some embodiments, the pivotal ball 112 preferably has a diameter of between 4 inches to 8 inches. In some embodiments, the height of the exercise device 100 from the floor will be approximately 2 inches higher than the diameter of the pivotal ball 112. Experience has shown that when the pivotal ball 112 has a diameter of between approximately 4 inches to 8 inches, the user experience is optimized because the range of angles that are produced are optimal. That is, in use, the exercise device will be capable of tilting at steep enough angles to challenge the user, without making the tilt angles too extreme for practical use.

In some embodiments, the base is mounted to a plurality of load sensors 118*a*, 118*b*, 118*c*, 118*d*. In some embodiments, four load sensors 118*a*, 118*b*, 118*c*, 118*d* are used and, as configured, each load sensor senses force in a different direction. Of course, different numbers of load sensors may be used as well. In some embodiments, load sensors manufactured by Accuway Technology International Limited (http://www.accuwaytech.com/) are employed. In some embodiments, the bottom of the base 114 has non slip feet or a pad to reduce movement of the base 114 while in use. In some embodiments, load sensors are not used.

Figure 4B:
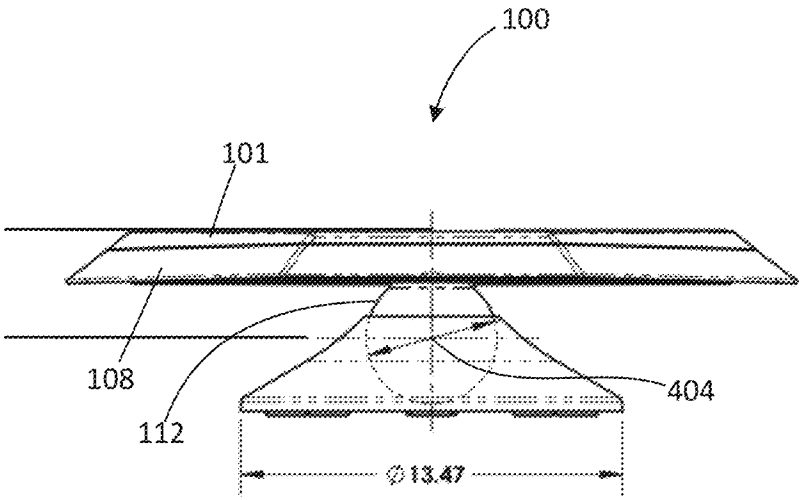
FIG. 4B illustrates a front view of the embodiment of FIG. 2.
Figure 4A:
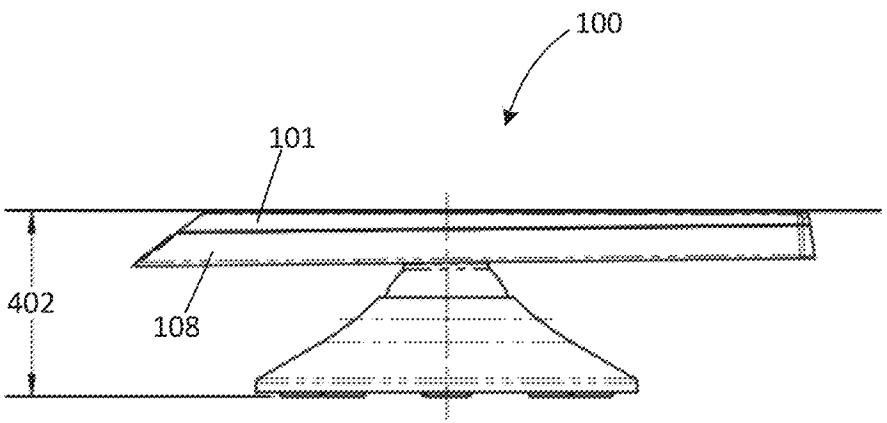
FIG. 4A illustrates a side view of the embodiment of FIG. 2.
Figure 4D:
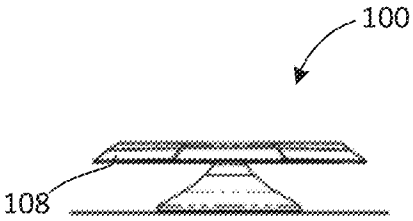
FIG. 4D illustrates a front view of the embodiment of FIG. 2.
Figure 4F:
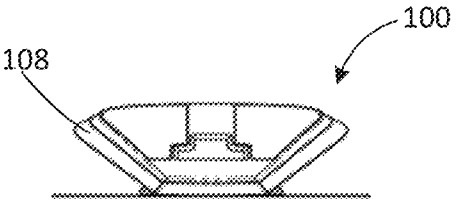
FIG. 4F illustrates a front view of the embodiment of FIG. 2 tilted forward.
Figure 4H:
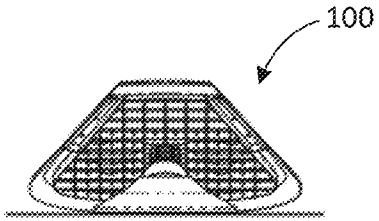
FIG. 4H illustrates a front view of the embodiment of FIG. 2 tilted backward.
Figure 4J:
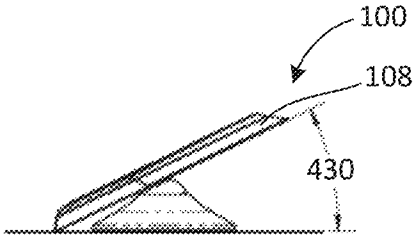
FIG. 4J illustrates a front view of the embodiment of FIG. 2 tilted on its side.
Figure 4C:
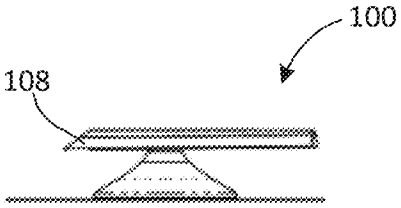
FIG. 4C illustrates a side view of the embodiment of FIG. 2.
Figure 4E:
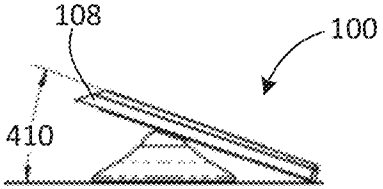
FIG. 4E illustrates a side view of the embodiment of FIG. 2 tilted forward.
Figure 4G:
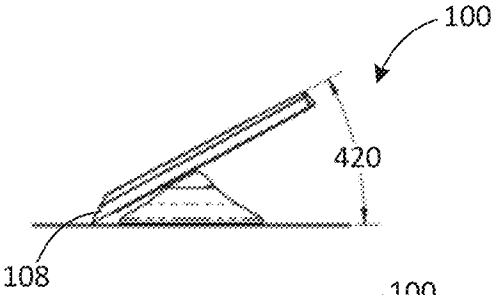
FIG. 4G illustrates a side view of the embodiment of FIG. 2 tilted backward.
Figure 4I:
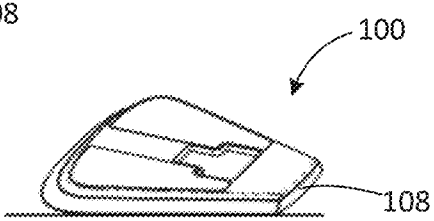
FIG. 4I illustrates a side view of the embodiment of FIG. 2 tilted on its side.

Referring now to FIGS. 4A-4J, various angles at which the exercise device 100 is capable of tilting for a specific diameter of the pivotal ball 112 are shown. As shown in FIG. 4A and FIG. 4B, the total height 402 of the exercise device 100 in the neutral position is approximately the height of the front of the padded portion 101 plus the height of the support portion 108 plus the diameter 404 of the pivot ball 112. Assuming a diameter 404 of approximately 4.625 inches, the total height 402 of the exercise device 100 in the neutral position is approximately 6.55 inches. Those dimensions result in the following tilt angles. As shown in FIG. 4C and FIG. 4D, in the neutral position, the support portion 108 of the exercise device 100 is not tilted, i.e., the tilt is 0 degrees. As shown in FIG. 4E and FIG. 4F, in the forward tilting position, the support portion 108 of the exercise device 100 can obtain a forward tilt a maximum 410 of approximately 19.5 degrees. As shown in FIG. 4G and FIG. 4H, in the backward tilting position, the support portion 108 of the exercise device 100 can obtain a backward tilt a maximum 420 of approximately 27.6 degrees. As shown in FIG. 4I and FIG. 4J, in the side tilting position, the support portion 108 of the exercise device 100 can obtain a side tilt a maximum 430 of approximately 35.8 degrees.

Figure 5:
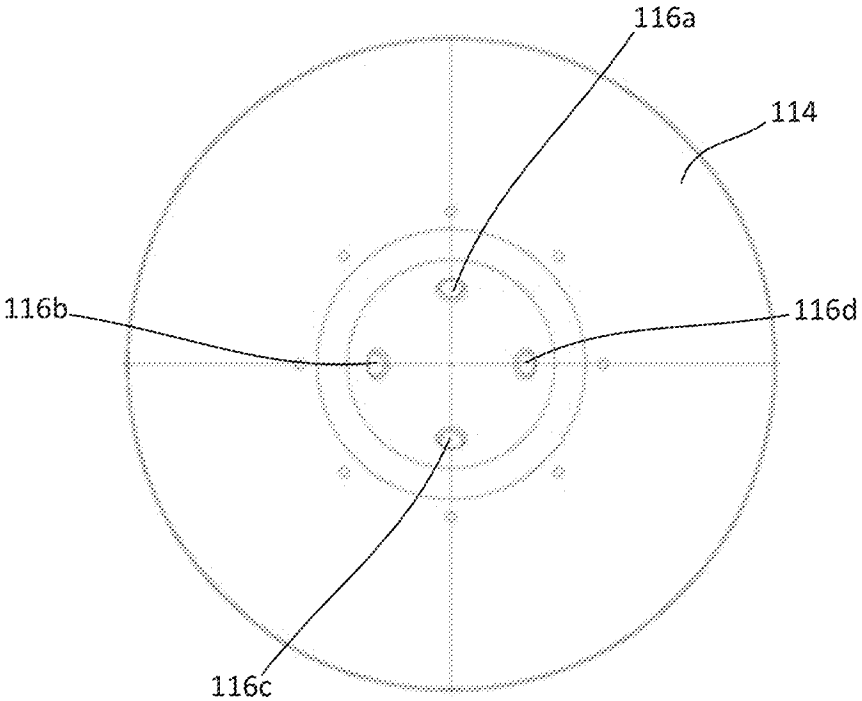
FIG. 5 illustrates a view of a ball joint assembly used in the embodiment of FIG. 2.

Referring now to FIG. 5, a plan view of the base 114, with ball bearings 116*a*, 116*b*, 116*c*, 116*d* embedded in the base 114 is shown. In some embodiments, four ball bearings 116 are used, but, of course, different numbers of ball bearings may be used.

Figure 6:
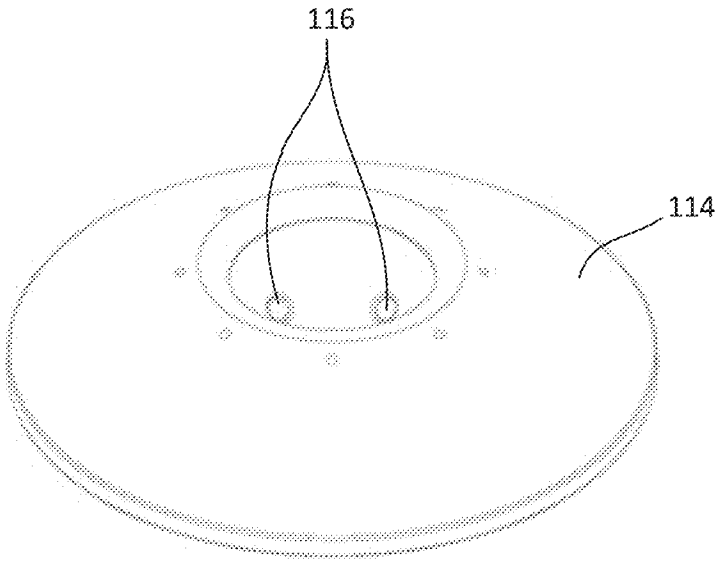
FIG. 6 illustrates a perspective view of the ball joint assembly of FIG. 5.

Referring now to FIG. 6, a perspective view of the base 114, with ball bearings 116 embedded in the base 114 is shown.

Figure 7:
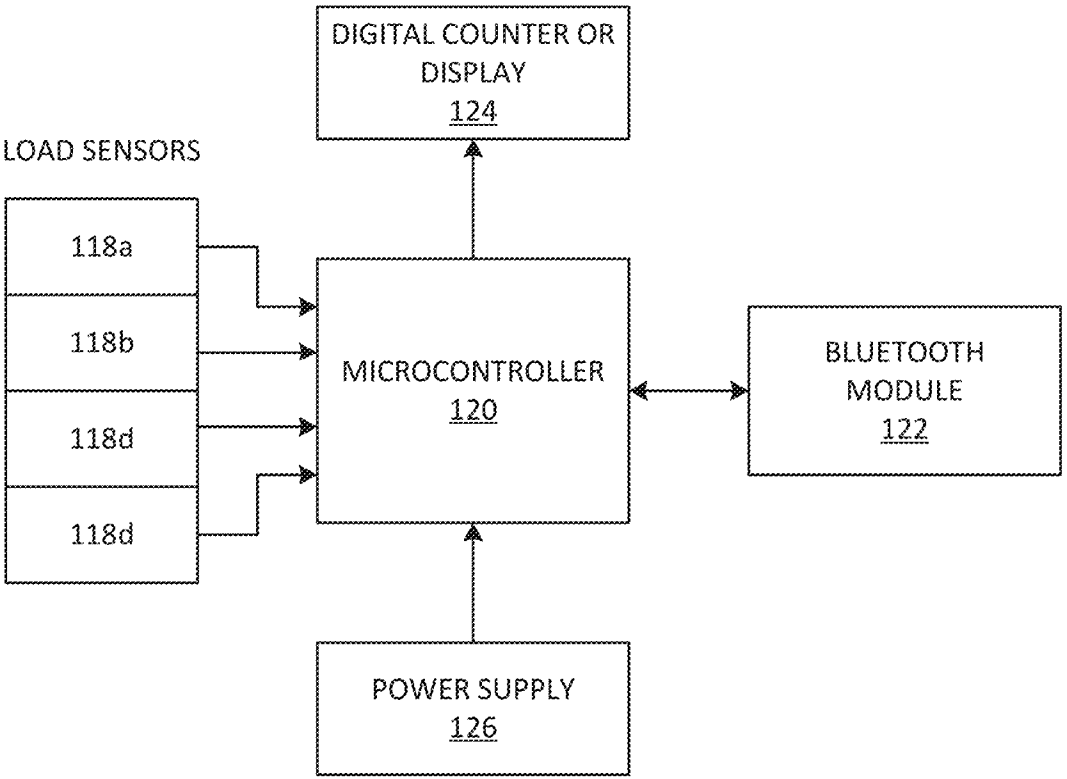
FIG. 7 illustrates a schematic of a processing unit for the exercise device.

Referring now to FIG. 7, in some embodiments, the load sensors 118*a*, 118*b*, 118*c*, 118*d* communicate information concerning the amount of force exerted on them to a microcontroller 120. The microcontroller 120 determines movement of the exercise device 100 based on the information provided by the load sensors 118*a*, 118*b*, 118*c*, 118*d*. In some embodiments, the microcontroller 120 is capable of communicating information to a Bluetooth module 122, or other suitable wireless communication module, to be transmitted to a smart device 106 having a display. Additionally, in some embodiments, the microcontroller 120 is capable of communicating information to a digital counter or display device 124 mounted on the exercise device 100 that is visible to the user without the need for a separate smart device 106. A power supply 126 provides power to the microcontroller.

Figure 8:
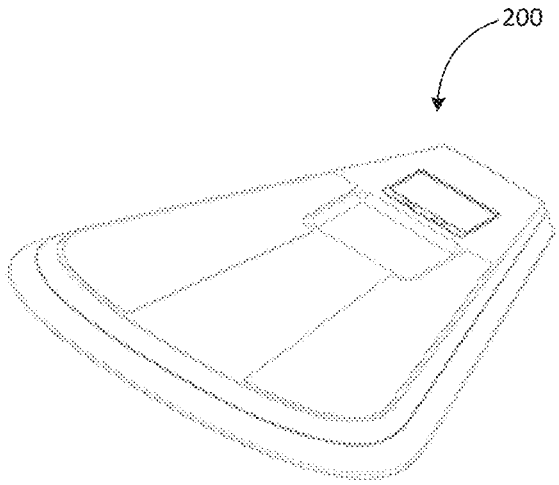
FIG. 8 illustrates a perspective view of a "Lazy Susan" embodiment.

Referring now to FIG. 8, a perspective view of a "Lazy Susan" embodiment 200 is shown.

Figure 9:
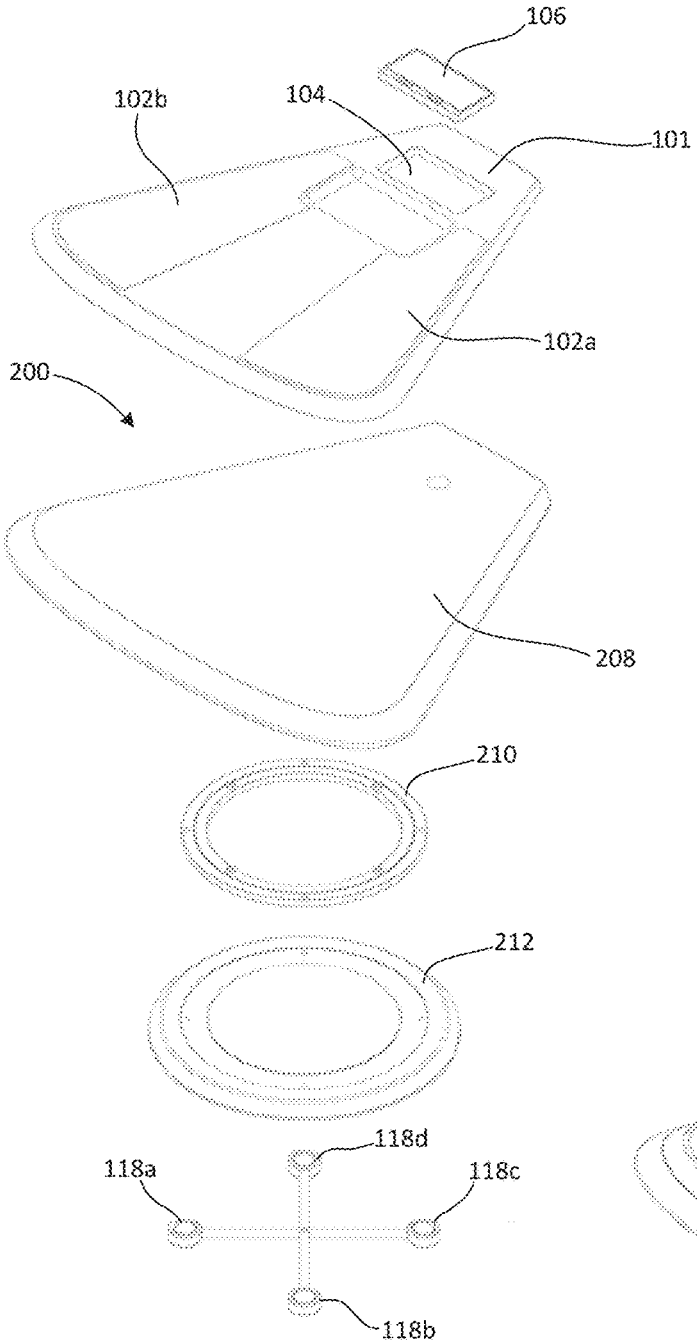
FIG. 9 illustrates an exploded view of components of the embodiment of FIG. 8.

Referring now to FIG. 9, an exploded view of a "Lazy Susan" embodiment 200 is shown. In some embodiments, the "Lazy Susan" embodiment 200 contains a padded portion 101, with padded sections 102*a*, 102*b* adapted to receive the arms or hands of a person performing a plank exercise. In some embodiments, padded portion 101 defines a recessed section 104 having a recessed area adapted to receive or hold a smart device 106 such as a smart phone. The padded portion 101 may be made of any suitably comfortable material, including without limitation foam, felt, polyethylene foams, or other suitable materials. In some embodiments, the padded portion 101 is mounted to a support board 208 adapted to support the padded portion 101 and which supports the body weight of a person performing a plank exercise. The support board 208 may be made of any suitably rigid material, including without limitation, wood, plastic, metal, or other suitable materials. In some embodiments, the support board 208 connects to a destabilizer comprising a ball bearing turntable 210 that in turn connects to a turntable base 212. The ball bearing turntable 210 in conjunction with the turntable base 212 allows the support board 208 to rotate freely around 360 degrees to facilitate performance of the twisting plank exercise shown in FIG. 1F. The ball bearing turntable 210 provides an unstable support in a plane parallel to the floor or other surface upon which the Lazy Susan embodiment 200 is placed. In some embodiments, the turntable base 212 has non-slip feet or a pad to be stationary so that it does not move relative to a support surface. In some embodiments, the "Lazy Susan" embodiment 200 also contains load sensors 118*a*, 118*b*, 118*c*, 118*d* and circuitry to monitor the forces applied to the load sensors, as described above.

Figure 10:
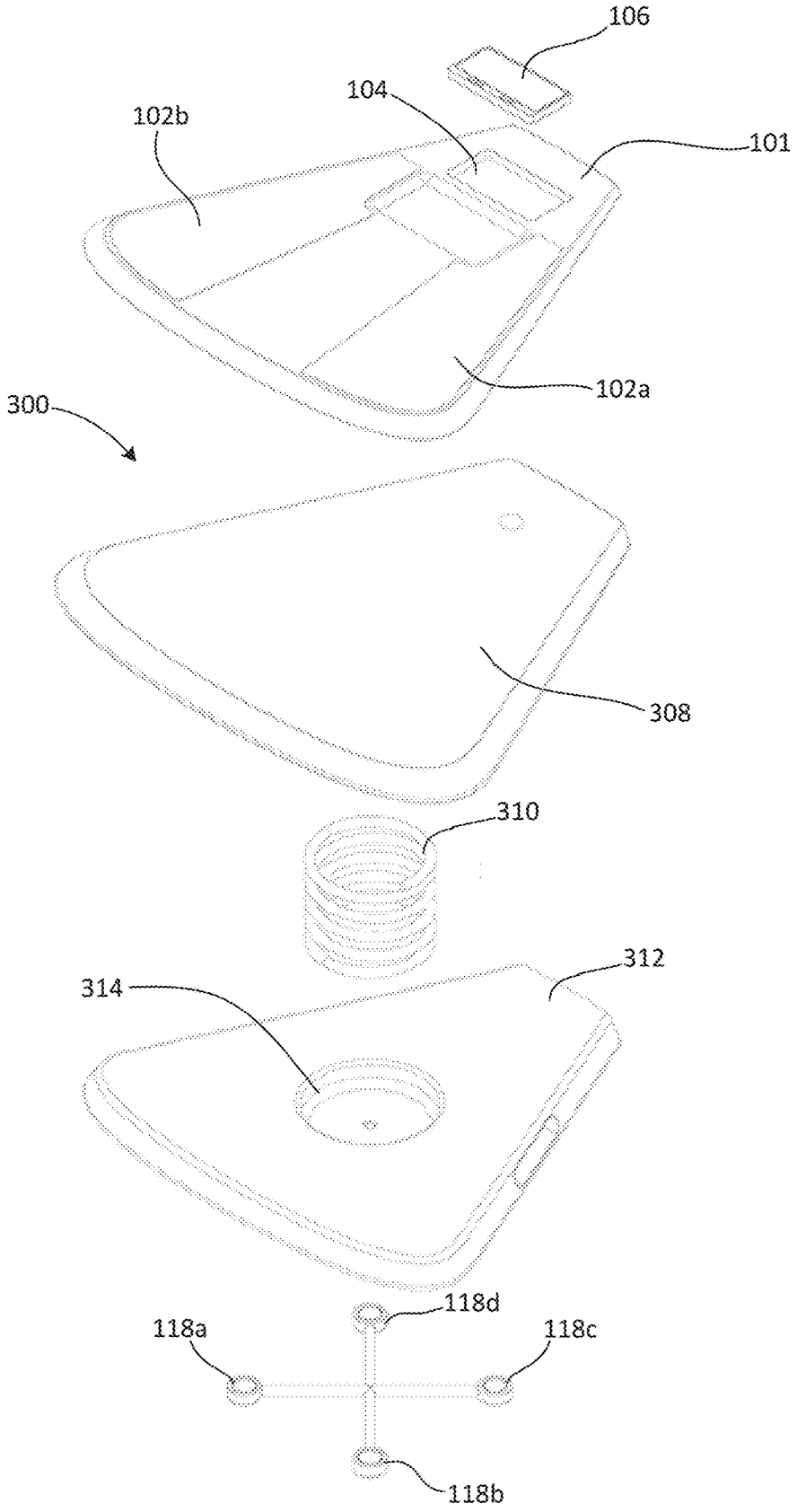
FIG. 10 illustrates an exploded view of a spring embodiment.

Referring now to FIG. 10, an exploded view of a spring embodiment 300 is shown. In some embodiments, the spring embodiment 200 contains a padded portion 101, with padded sections 102*a*, 102*b* adapted to receive the arms or hands of a person performing a plank exercise. In some embodiments, padded portion 101 defines a recessed section 104 having a recessed area adapted to receive or hold a smart device 106 such as a smart phone. The padded portion 101 may be made of any suitably comfortable material, including without limitation foam, felt, polyethylene foams, or other suitable materials. In some embodiments, the padded portion 101 is mounted to a spring support board 308 adapted to support the padded portion 101 and which supports the body weight of a person performing a plank exercise. The bottom of spring support board 308 is adapted to receive securely a destabilizer comprising a spring 310. In some embodiments, the spring 310 is connected or fastened to the spring support board 308. The spring 310 is in turn connected to a spring base 312. The spring 310 provides an unstable support and allows the user to lean at different angles by providing a muscular contraction or shifting one's body weight at various angles. The spring base 312 defines a recessed portion 314 designed to receive securely spring 310. In some embodiments, the spring 310 is connected or fastened to the spring base 312. In some embodiments, the spring base 312 has non-slip feet or a pad to be stationary so that it does not move relative to a support surface. In some embodiments, the spring embodiment 300 also contains load sensors 118*a*, 118*b*, 118*c*, 118*d* and circuitry to monitor the force applied to the load sensors, as described above.

Figure 11:
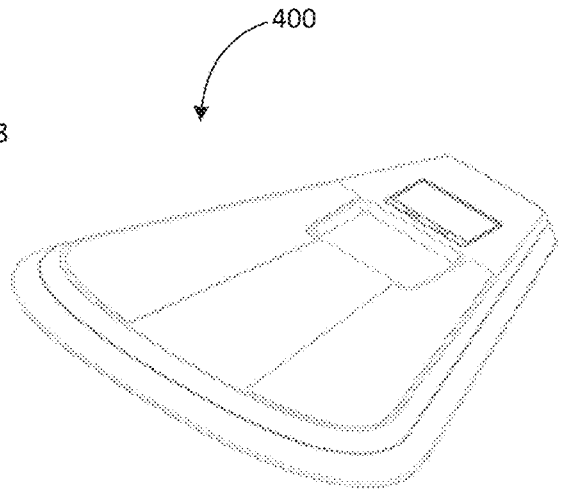
FIG. 11 illustrates a static embodiment.

Referring now to FIG. 11, a perspective view of a static embodiment 400 is shown.

Figure 12:
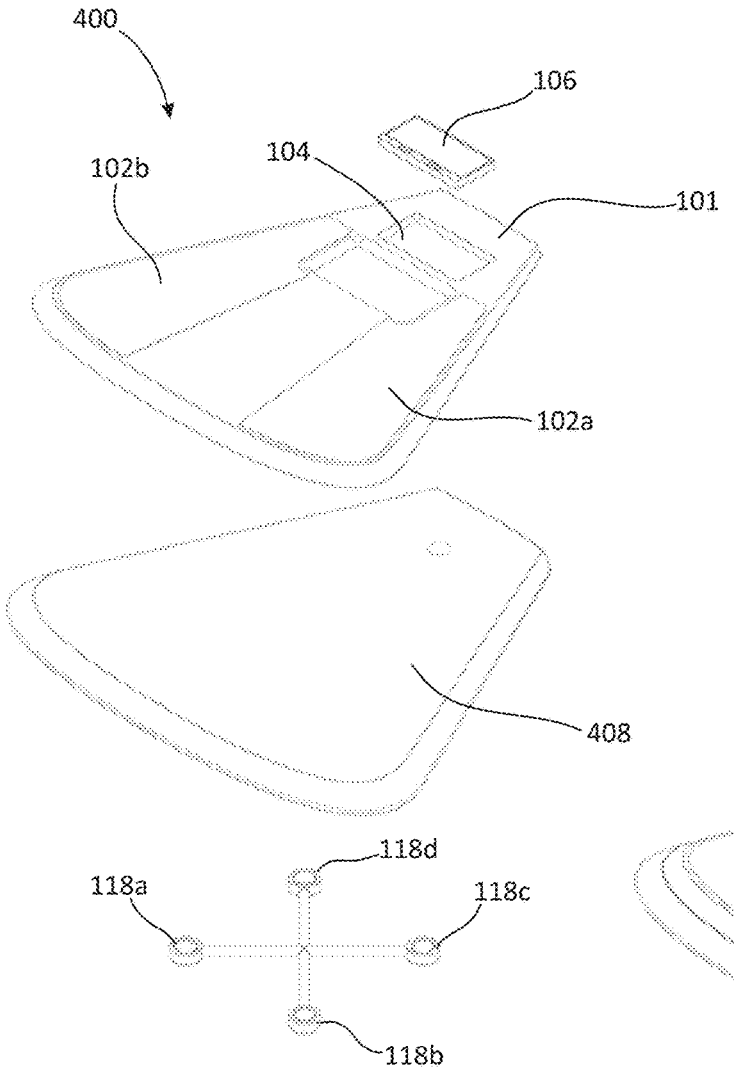
FIG. 12 illustrates an exploded view of components of the embodiment of FIG. 10.

Referring now to FIG. 12, an exploded view of a static embodiment 400 is shown. In some embodiments, the static embodiment 400 contains a padded portion 101, with padded sections 102*a*, 102*b* adapted to receive the arms or hands of a person performing a plank exercise. In some embodiments, padded portion 101 defines a recessed section 104 having a recessed area adapted to receive or hold a smart device 106 such as a smart phone. The padded portion 101 may be made of any suitably comfortable material, including without limitation foam, felt, polyethylene foams, or other suitable materials. In some embodiments, the padded portion 101 is mounted to a support board 408 adapted to support the padded portion 101 and which supports the body weight of a person performing a plank exercise. The support board 408 may be made of any suitably rigid material, including without limitation, wood, plastic, metal, or other suitable materials. In some embodiments, the support board 408 has non-slip feet or a pad. In some embodiments, the static embodiment 400 also contains load sensors 118*a*, 118*b*, 118*c*, 118*d* and circuitry to monitor the force applied to the load sensors, as described above.

Figure 13:
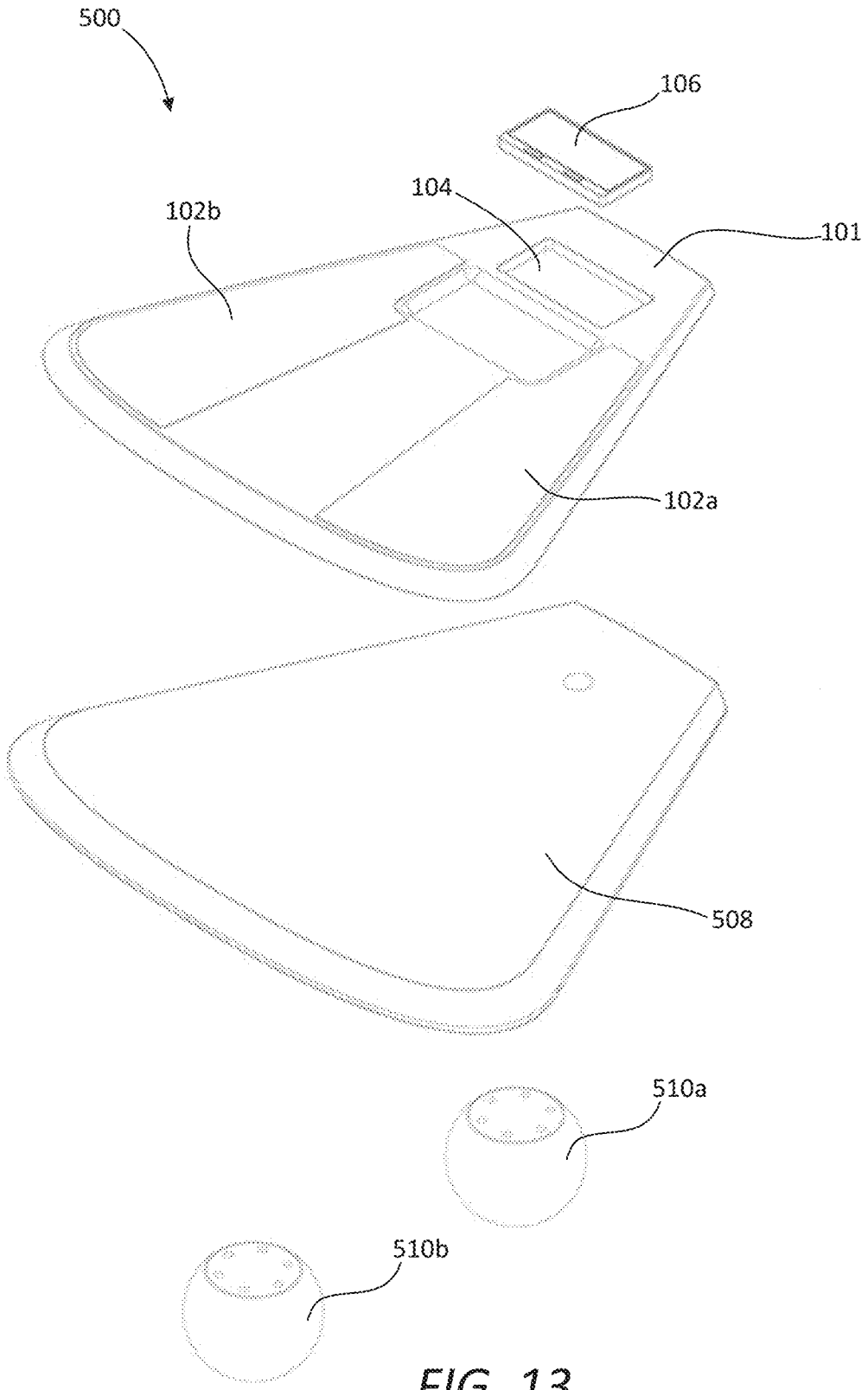
FIG. 13 illustrates an exploded view of a pivot ball embodiment.

Referring now to FIG. 13, an exploded view of a pivot ball embodiment 500 is shown. In some embodiments, the pivot ball embodiment 500 contains a padded portion 101, with padded sections 102*a*, 102*b* adapted to receive the arms or hands of a person performing a plank exercise. In some embodiments, padded portion 101 defines a recessed section 104 having a recessed area adapted to receive or hold a smart device 106 such as a smart phone. The padded portion 101 may be made of any suitably comfortable material, including without limitation foam, felt, polyethylene foams, or other suitable materials. In some embodiments, the padded portion 101 is mounted to a support board 508 adapted to support the padded portion 101 and which supports the body weight of a person performing a plank exercise. The support board 508 may be made of any suitably rigid material, including without limitation, wood, plastic, metal, or other suitable materials. The bottom of the support board 508 is adapted to receive one or more destabilizers comprising pivot balls 510*a*, 510*b*. In some embodiments, the pivot balls 510*a*, 510*b* are generally spherical, but have a flat portion on top to connect to the bottom of the support board 508. The pivot balls 510*a*, 510*b* are fastened or connected to the bottom of the support board 508 or may be permanently molded to the support board 508. In some embodiments, the bottom of the pivot balls 510*a*, 510*b*, are rounded to provide an unstable support to facilitate creating the ability to move side to side when doing a plank exercise. In some embodiments, just a single pivot ball 510*a* is used, and the pivot ball embodiment 500 may pivot in any direction around the pivot ball 510*a*.

Figure 14:
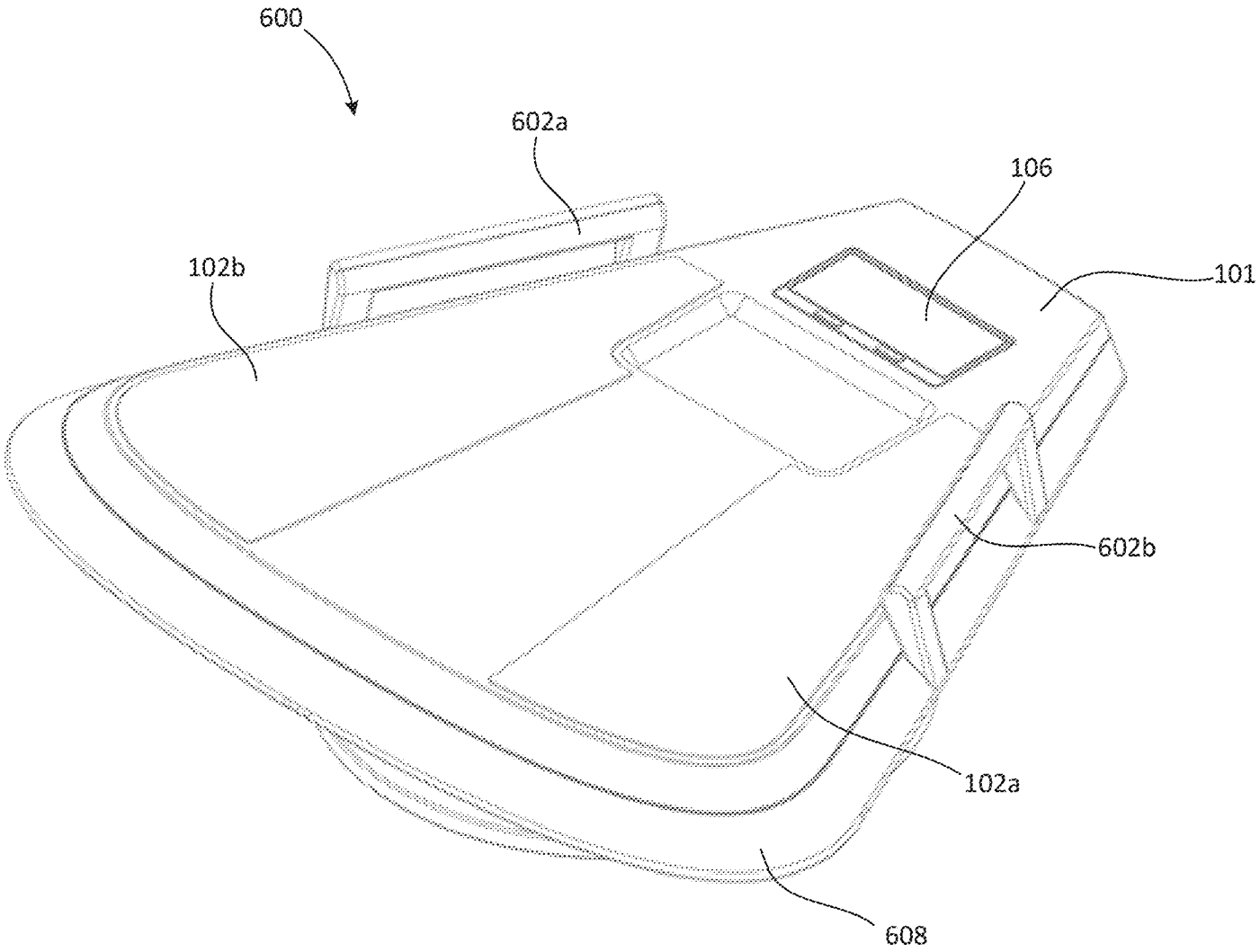
FIG. 14 illustrates a side handle embodiment.

Referring now to FIG. 14, a perspective view of a side handle embodiment 600 is shown. This embodiment may incorporate the features of any of the other embodiments discussed above, but in addition, handles 602*a*, 602*b* are provided mounted to a support board 608. The handles 602*a*, 602*b* may be fastened to the support board 608, molded to the support board 608, or may be removably attached to the support board 608. While handles 602*a*, 602*b* are shown and described, it would be apparent to one of ordinary skill in the art that other types of handles may be incorporated, including without limitation, push-up style handles, or long bars for a hand grip running parallel to the support board 608.

Figure 15:
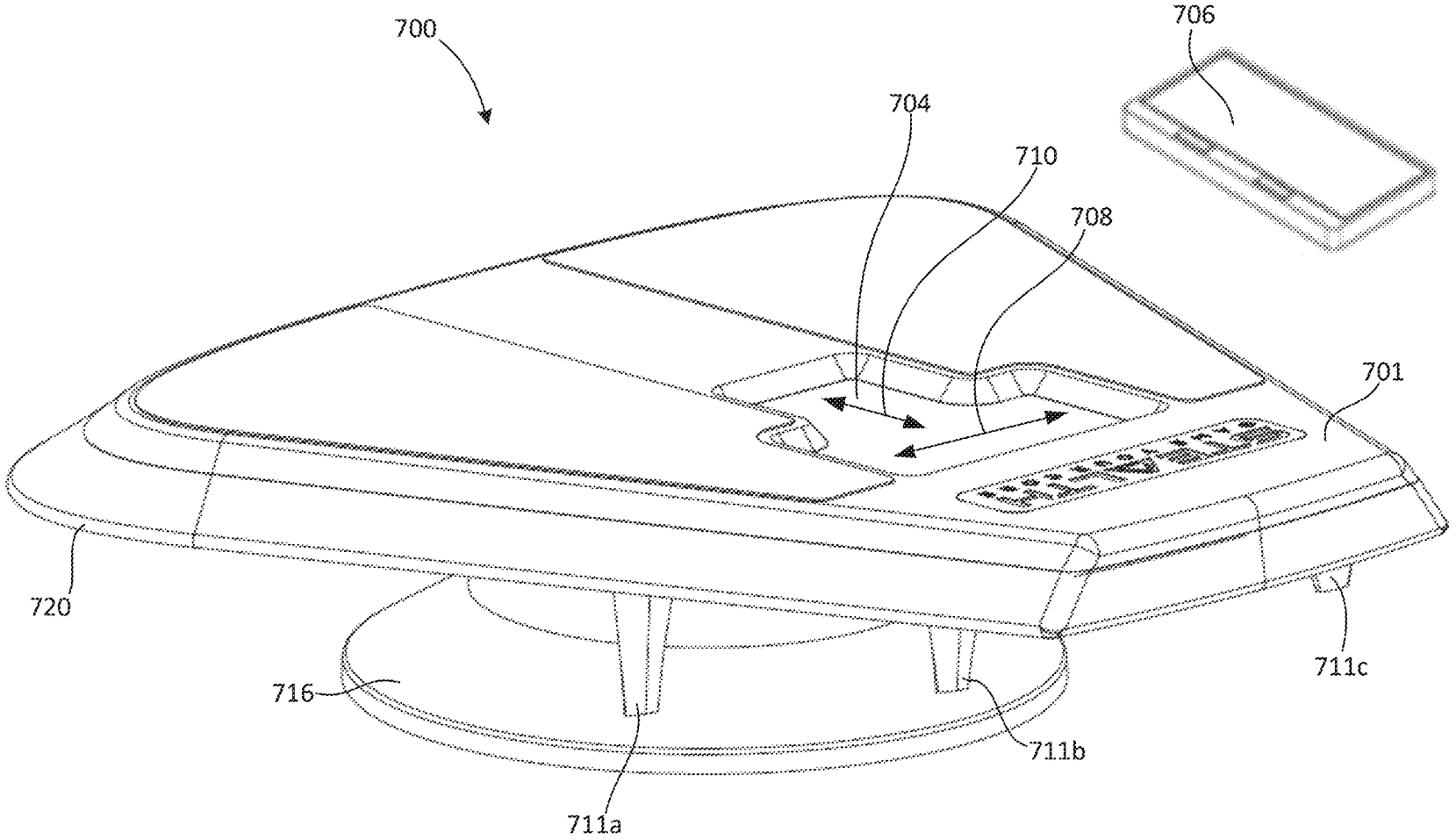
FIG. 15 illustrates a perspective view of an off-center embodiment.
Figure 16:
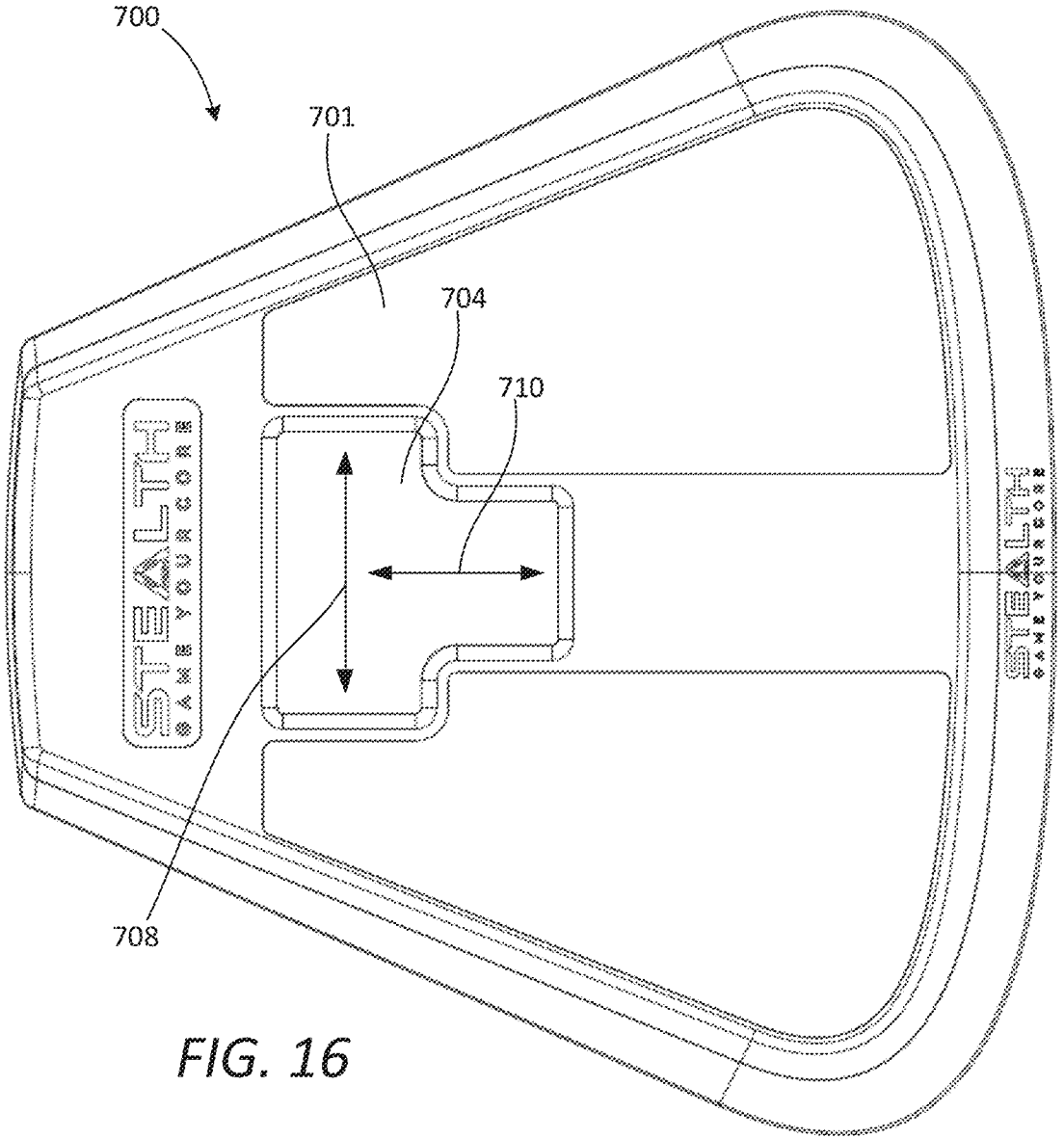
FIG. 16 illustrates a top view of the embodiment of FIG. 15.
Figure 17:
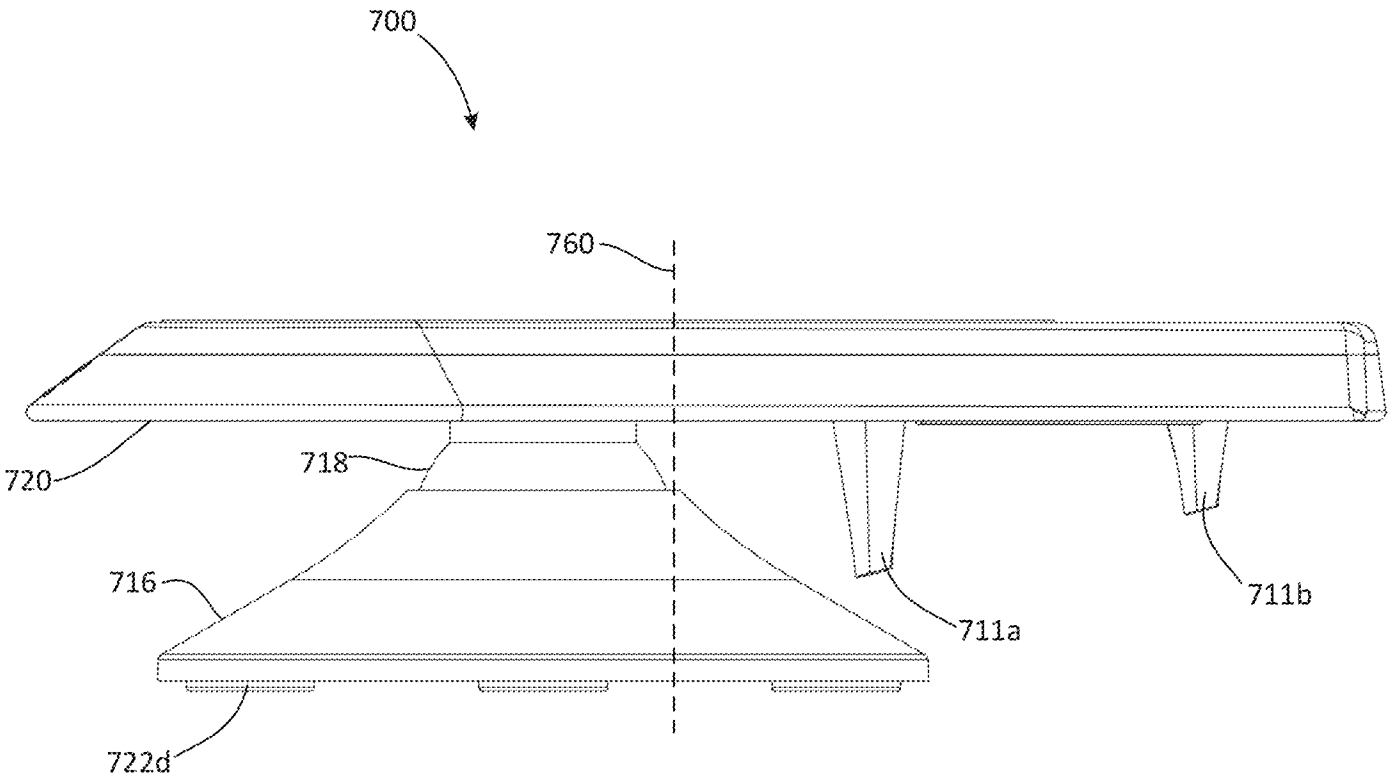
FIG. 17 illustrates a side view of the embodiment of FIG. 15.
Figure 18:
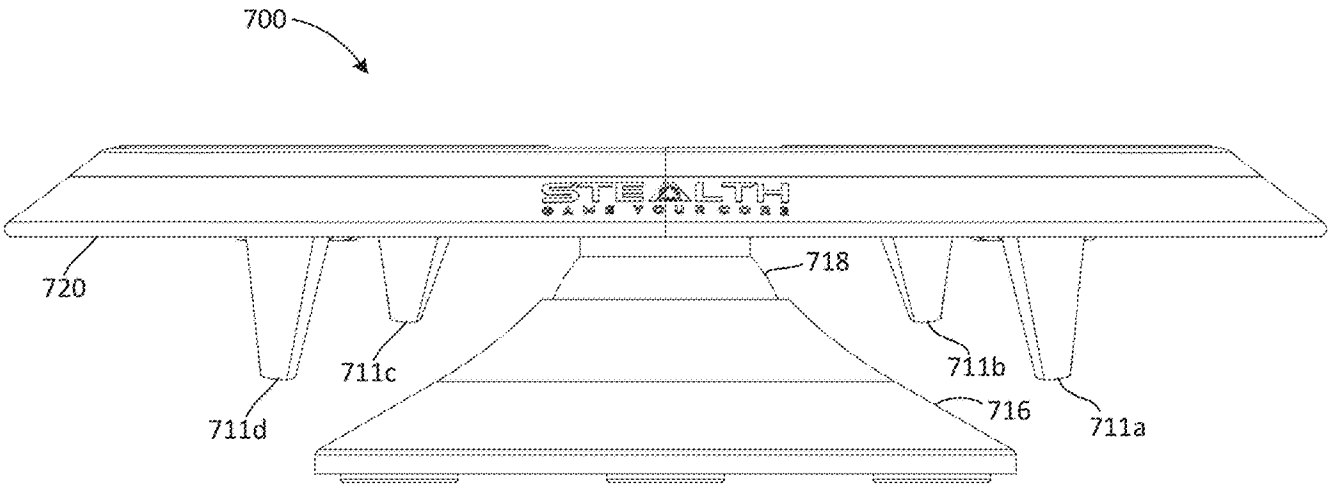
FIG. 18 illustrates a front view of the embodiment of FIG. 15.
Figure 19:
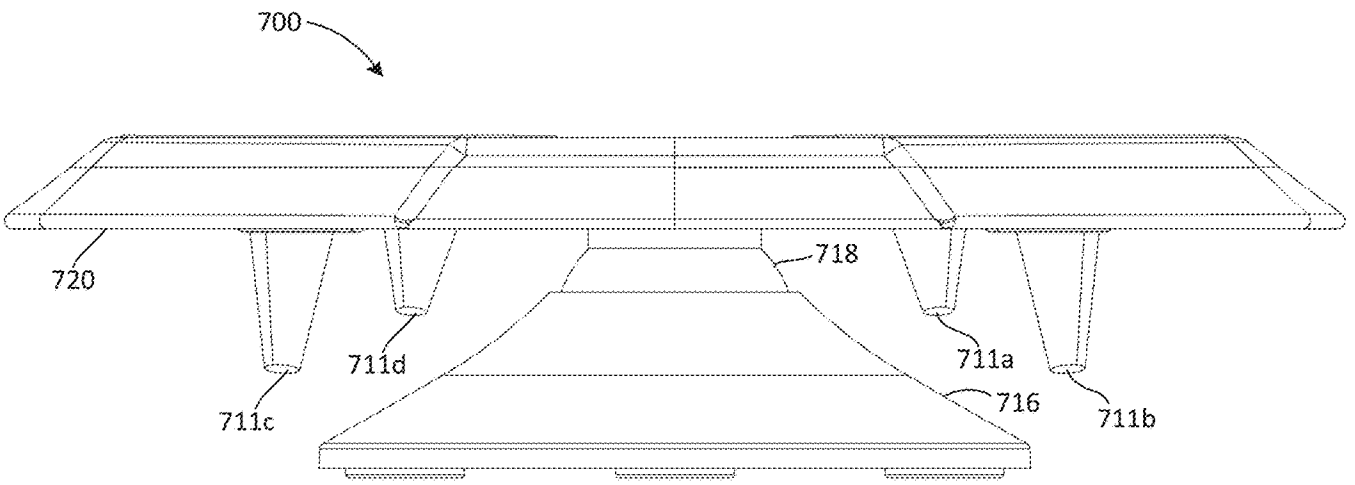
FIG. 19 illustrates a back view of the embodiment of FIG. 15.
Figure 20:
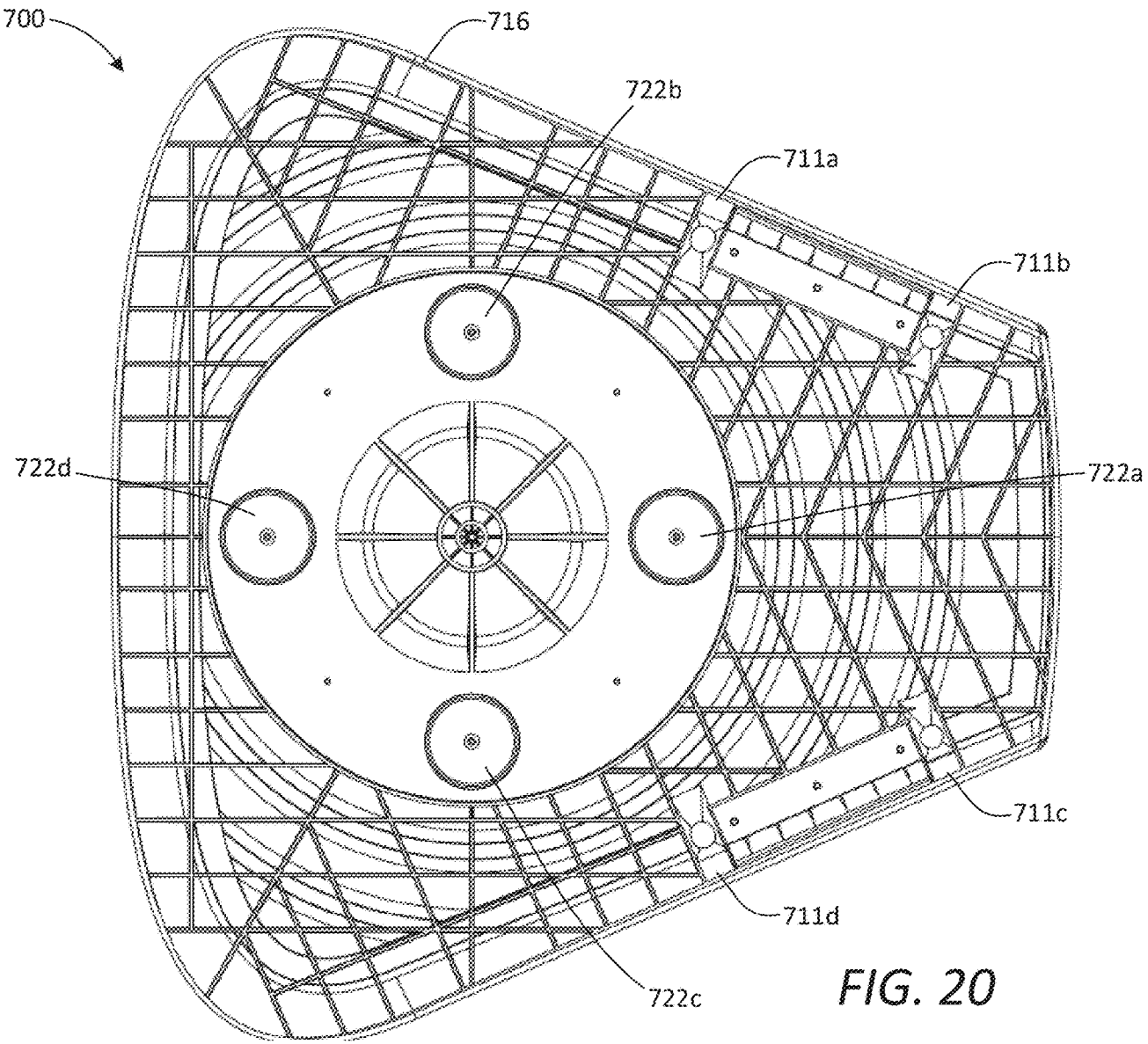
FIG. 20 illustrates a bottom view of the embodiment of FIG. 15.

Referring now to FIG. 15, FIG. 16, FIG. 17, FIG. 18, FIG. 19, and FIG. 20 an off-center embodiment 700 is shown. Referring now to FIG. 15 and FIG. 16, this embodiment may incorporate the features of any of the other embodiments discussed above, but in addition, in some embodiments, padded portion 701 defines a recessed section 704 having a recessed area adapted to receive or hold a smart device 706 such as a smart phone in an orientation either horizontal 708 to the user, or vertical 710 to the user. In some embodiments, load sensors and the electronics of FIG. 7 are not used, and instead, a smart device 706 such as a smart phone with its own accelerometers and a programmed app is used. Referring now to FIG. 15, FIG. 17, FIG. 18, FIG. 19, and FIG. 20, in some embodiments, the off-center embodiment includes a plurality of stops 711*a*, 711*b*, 711*c*, 711*d* connected to the underside of the support portion 720. When the off-center embodiment 700 is used and the user moves from side to side, the stops 711*a*, 711*b*, 711*c*, 711*d* prevent movement of the off-center embodiment 700 to a point where a user's fingers would be pinched. Referring now to FIG. 17, in some embodiments, the off-center embodiment 700 includes a base 716 to which is connected a destabilizer comprising a pivot ball 718, which in turn is connected to the support portion 720. In some embodiments, the base 716 is stationary so that it does not move relative to a support surface. In some embodiments, the pivot ball 718 is connected to the support portion 720 forward of the center of the support portion 720. Testing has shown that placing the pivot ball 718 forward of the center of the support portion 720, or forward from the center of the support portion 720, provides a more optimal exercise experience than if the pivot ball 718 is centered on the support portion 720 because the user's weight during use is more properly balanced. That is, in some embodiments, the center of gravity of the user's body will be located on the user's elbows when in the plank position. In some embodiments, a more optimal location than the center of the support portion 720 for the pivot ball 718 is in line with the user's elbows, which is not at the center of the support portion 720. In one embodiment, the longitudinal length of the support portion 720 is approximately 24 inches and the pivot ball 718 is connected to the support portion 720 approximately 2.4 inches, or approximately ten percent, forward of the center line 760 of the support portion 720. In various embodiments the location of the pivot ball 718 is between 1 inch to 3 inches, or approximately 4 percent to 12.5 percent off-center forward of the center line 760 of the support portion 720. Referring now to FIG. 15, FIG. 17, FIG. 18, FIG. 19, and FIG. 20, in some embodiments, load sensors 722*a*, 722*b*, 722*c*, 722*d*, are provided mounted to the bottom of the base 716 to monitor force exerted on the device by the user.

Figure 21:
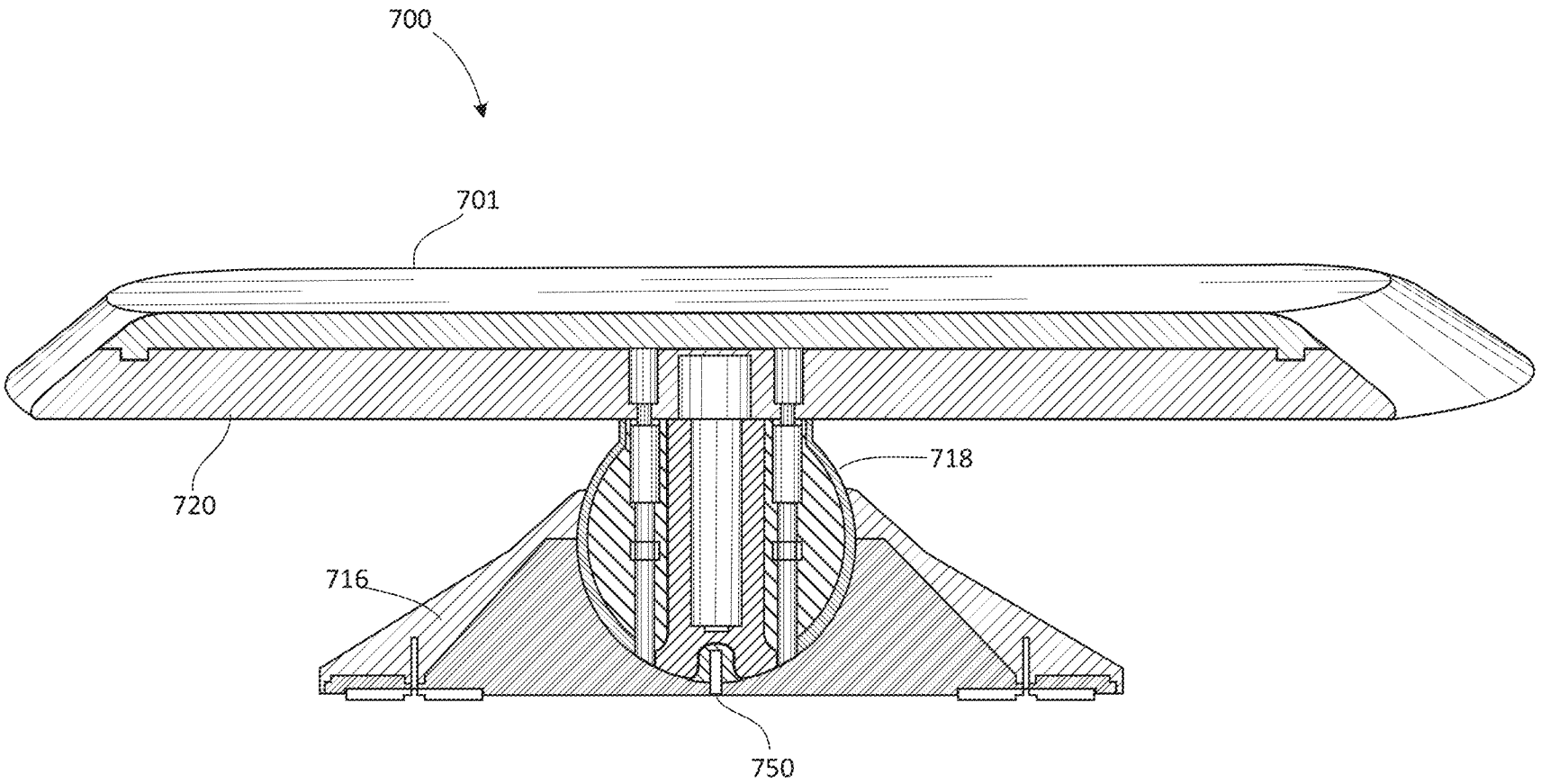
FIG. 21 illustrates an elevation cutaway view of an embodiment employing a boss.
Figure 22:
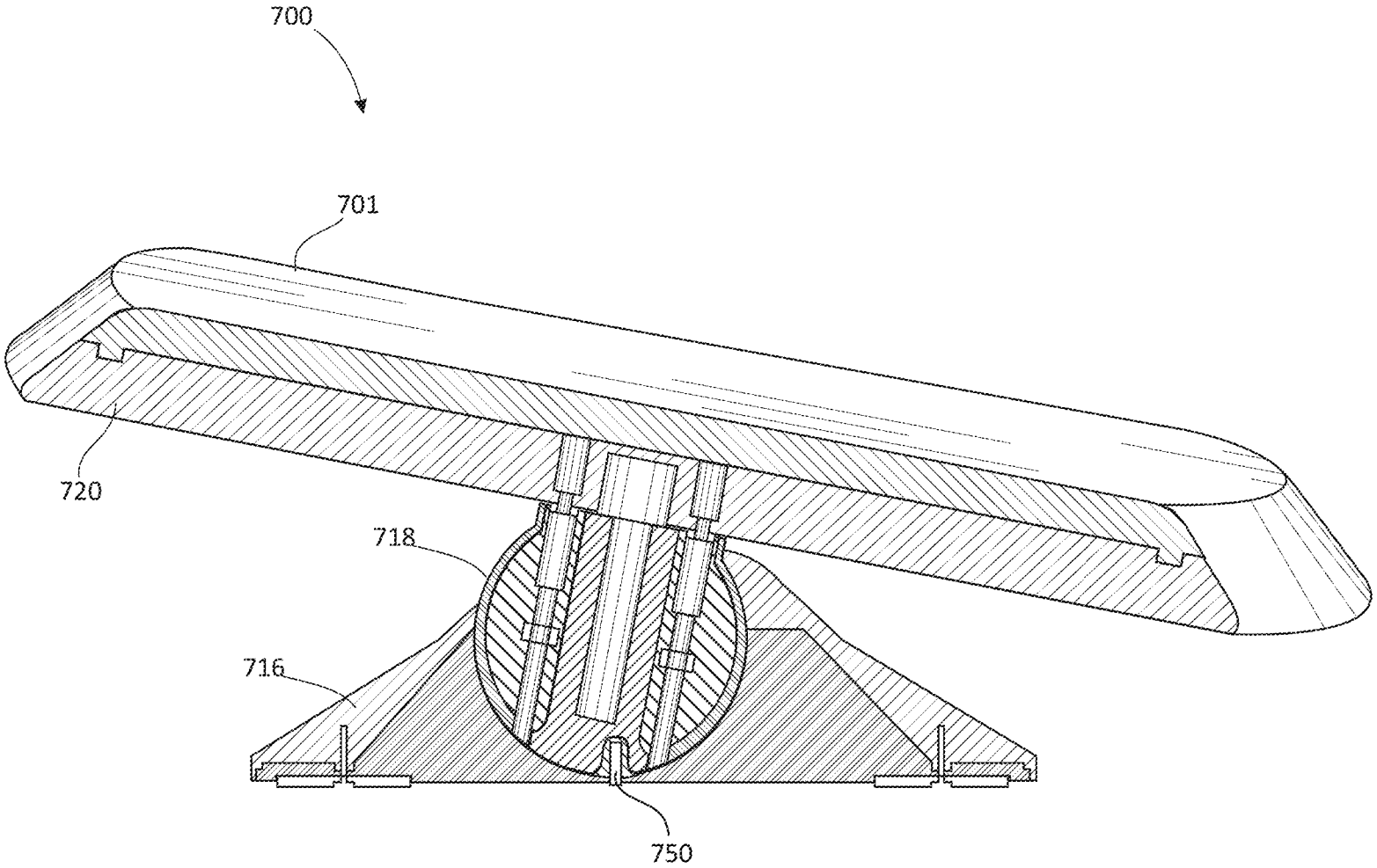
FIG. 22 illustrates an elevation cutaway view of the embodiment of FIG. 21.

Referring now to FIG. 21 and FIG. 22 in some embodiments the base incorporates a boss 750. As shown in FIG. 22, when the embodiment 700 tilts, the boss 750 will prevent tilting beyond a predetermined amount.

Any of the embodiments described may also include a built in digital counter or display device 124. The built in digital counter or display device 124 will provide the user with data and instruction that will guide the user to twist, turn and lean in various angles while being timed. In some embodiments, the built in digital counter or display device 124 will have LCD counters or a graphical display, and accelerometers or other force sensors to measure the various angles of the support board portion at any given time and subsequently convey that information to the user graphically. At the completion of the predetermined workout the user will receive data informing the user of the time and score for proper completion of exercises. A score may be calculated using the force (body weight applied to the support board) and the time and difficulty of the workout program.

Any of the embodiments described may also include custom applications, either for the associated smart device, or to be displayed on the built in display. The applications guide the user through fun, interactive workouts. The applications will be calibrated and synchronized with the range of movement of the exercise device. The applications will also be capable of receiving data via Bluetooth from the motion and load sensors built into the device. The applications will also be able to be controlled by via another smart device so as a fitness trainer can send instructions to the users in real time using a separate smart device.

Any of the embodiments described may also include applications incorporating the concept of a core score. In the past, some measurements of an individual's measurement of fitness level has been determined by several methods: 1. Body Weight vs Height charts; 2. Body Mass Index (BMI); 3. Body fat percentage. These methods can be inaccurate depending on body types. Bodybuilders for example will often be identified as obese when using BMI due to their high amount of muscle mass. Using weight and height charts presents the same problem. One person could be 200 lbs with a big belly and another person could be 200 lbs and appear extremely muscular and fit. CORE SCORE is an accurate way to determine an individual's level of fitness by determining their overall CORE ENDURANCE LEVEL. Someone who is unfit will likely have a weak core and will be unable to hold the plank position while performing set routines for any length of time. The goal of CORE SCORE is to create a standard protocol for users to test their CORE ENDURANCE STRENGTH. This is accomplished by taking into account the FORCE applied to the exercise device, by the length of time that force is maintained while performing a series of exercises. The stronger the CORE ENDURANCE the longer the user will be able to hold the various positions. If the user drops to his or her knees, the load sensors will relay that the FORCE has changed and the exercise time will be stopped, thereby negatively affecting the CORE SCORE. CORE SCORE could become a new standard for determining the overall health of person since BELLY SIZE is such a factor in overall health.

Any of the embodiments described may also function as a full-body controller for integrated or remote gaming. The array of motion detecting and weight detecting sensors provides an immersive and intuitive gaming experience for a variety of applications. For example, the exercise device could be used to play a car racing game by having the motion of the board serve as the steering controller for the car. The exercise device can also function as a social media tool with which a user can perform a workout that is recorded visually with a graphical user interface and then sent to others as an invitation to attempt to complete the workout. Tilting of the exercise device surface can control directional motion, speed, and other gaming aspects.

Figure 23:
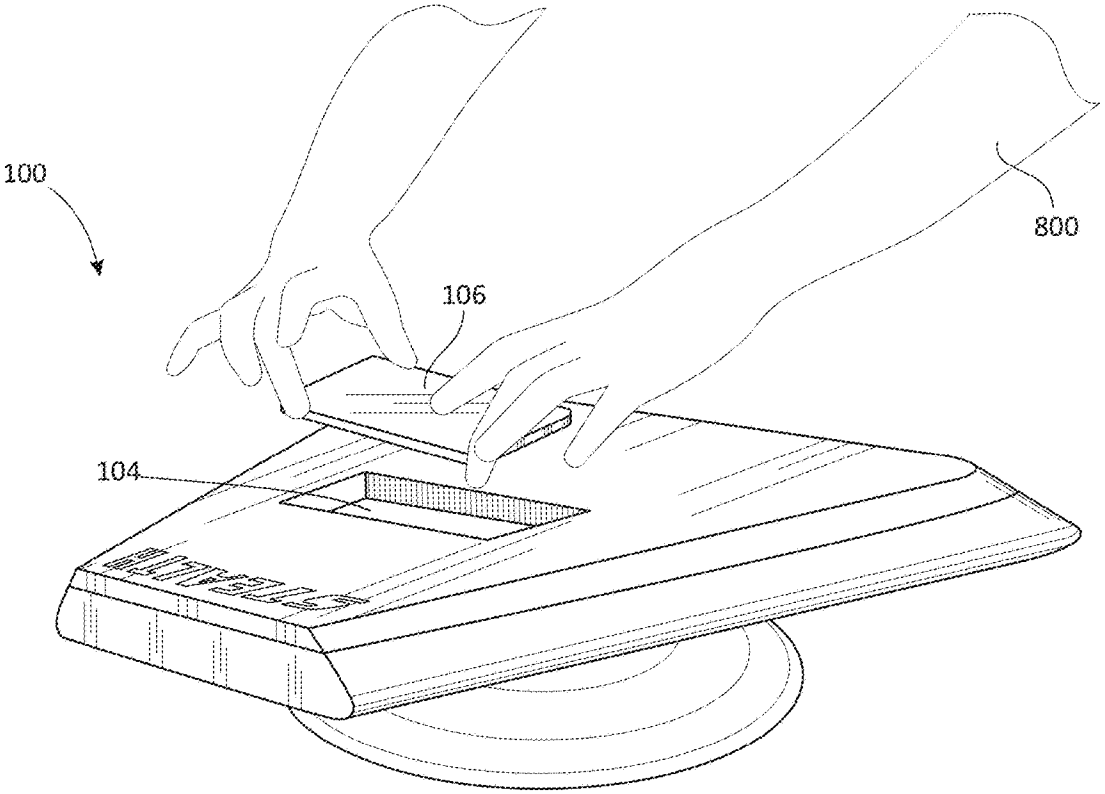
FIG. 23 illustrates a display device being placed in an exercise device.

Referring now to FIG. 23, in some embodiments, to play a game using the exercise device 100, a user 800 may activate and place a smart device 106 such as a smart phone, into the recessed section 104 having a recessed area adapted to receive or hold the smart device 106. The smart device 106 is programmed to execute or run a game on the smart device 106. Of course, a display device that is not a smart device 106 may also be used instead of the smart device 106.

Figure 24:
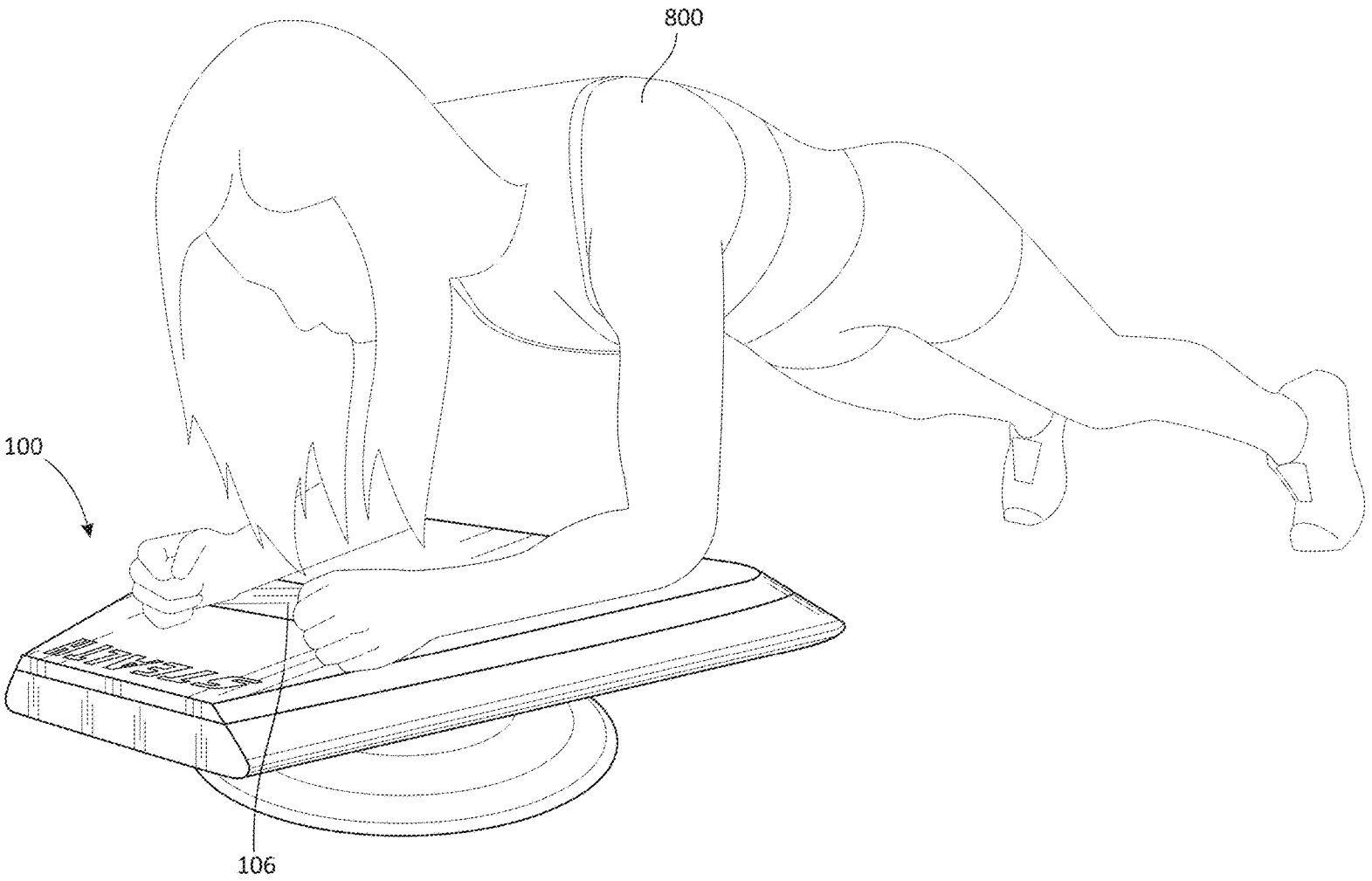
FIG. 24 illustrates a user playing a game on an exercise device.
Figure 25:
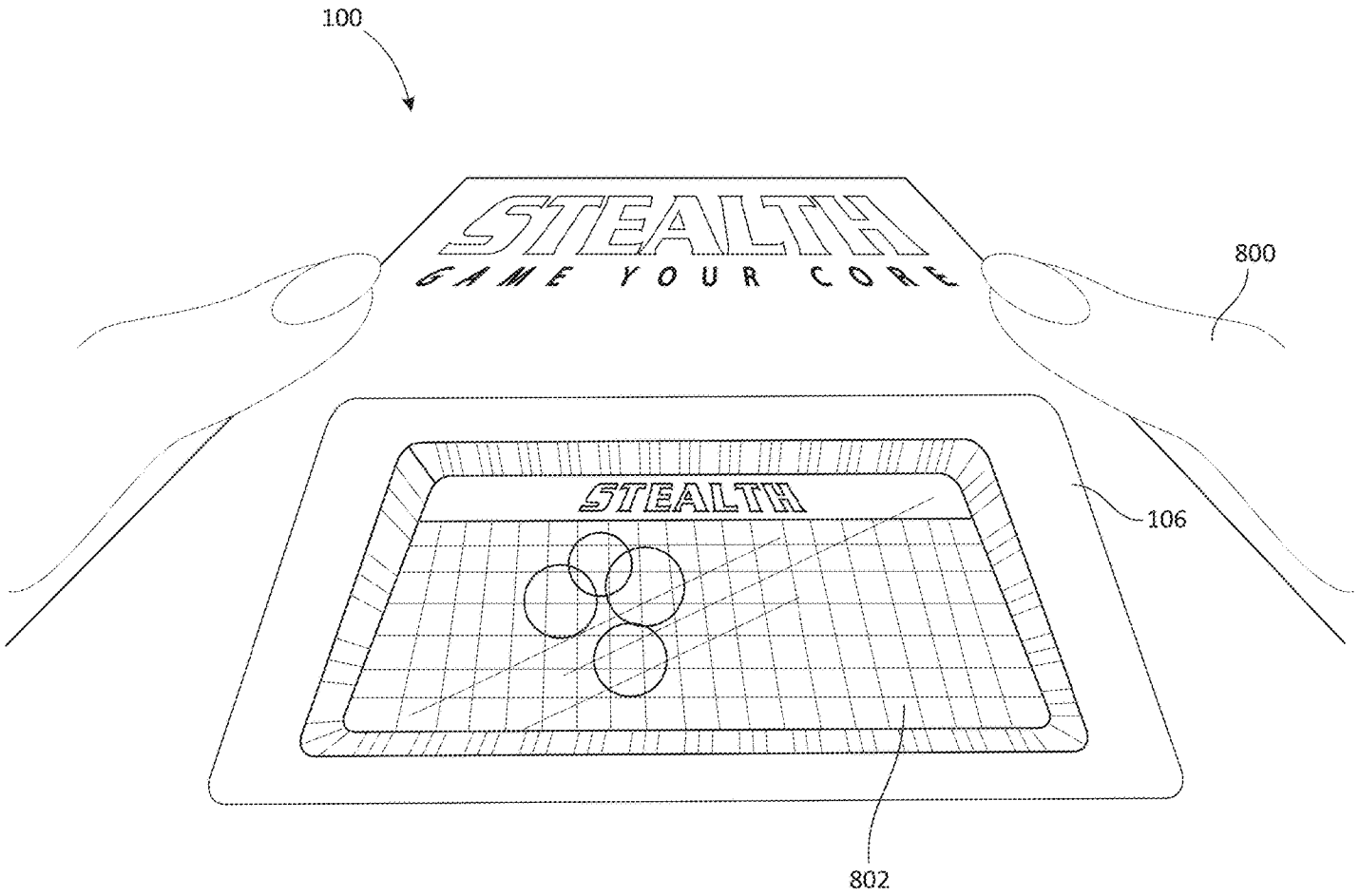
FIG. 25 illustrates a game display screen on an exercise device.
Figure 26:
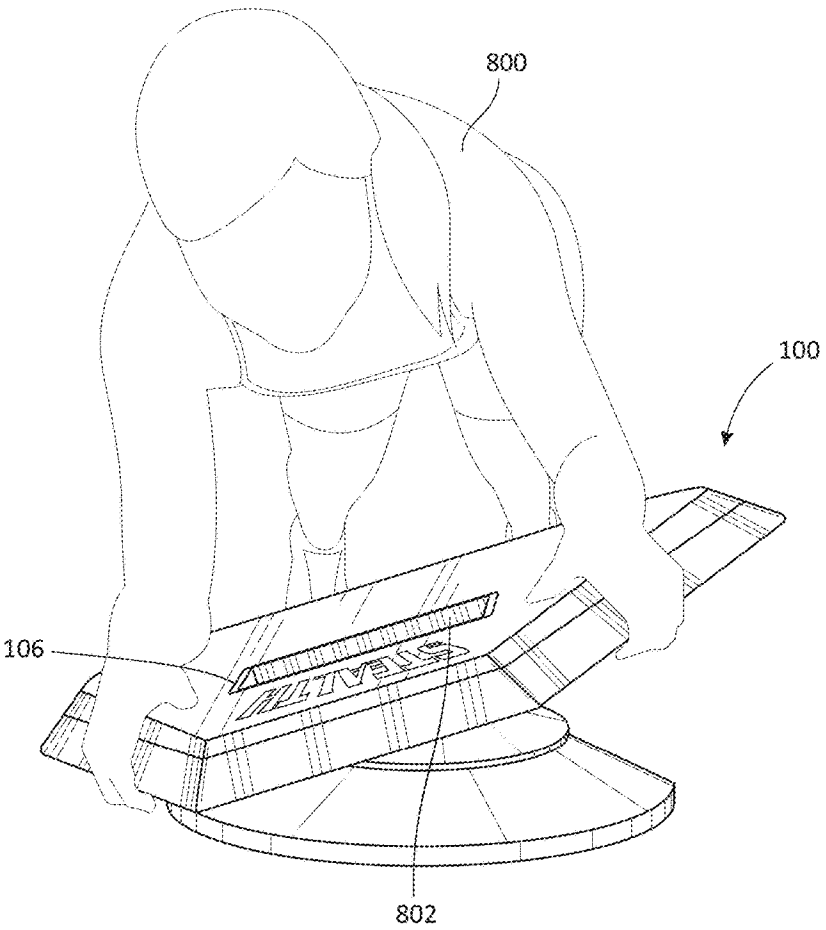
FIG. 26 illustrates a user exercising by tilting an exercise device.

Referring now to FIG. 24, in some embodiments, to play a game using the exercise device 100, the user 800, assumes the plank position, placing the user's 800 forearms on the exercise device 100. Of course, instead of placing forearms on the exercise device 100, the user's 800 hands or arms could be placed on the exercise device 100. Referring now to FIG. 25, the smart device 106 displays one or more game screens 802 directing the user to tilt the exercise device 100 to accomplish a goal, such as, for example, moving a sight to cover a target. Referring now to FIG. 26, the user 800 may tilt the exercise device 100 in response to the indications of the game screens 802 on the smart device 106.

Figure 27:
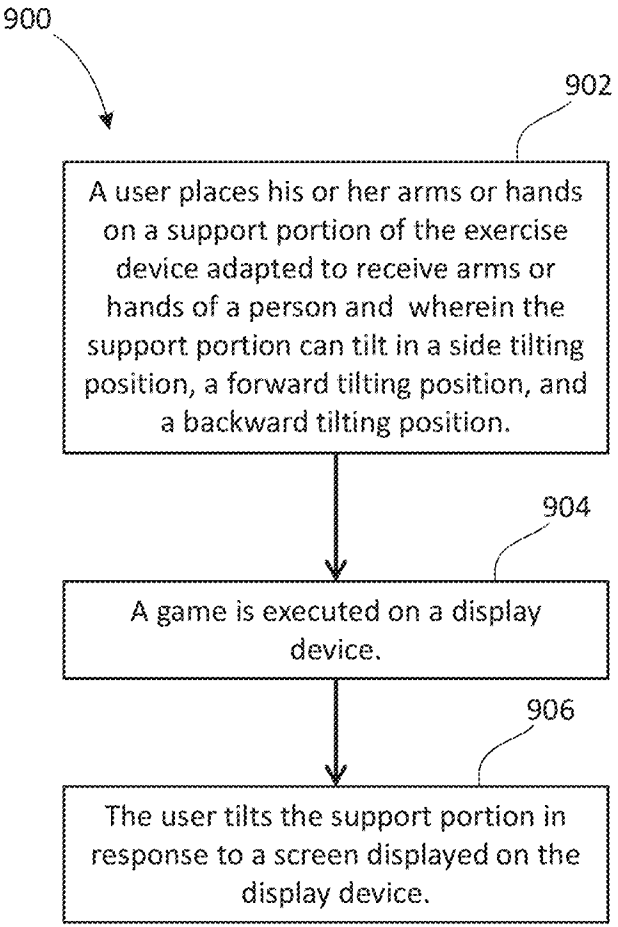
FIG. 27 illustrates a method of playing a game on an exercise device.

Referring now to FIG. 27, steps for a method of playing a game on an exercise device 900 are shown. In the first step 902 a user places his or her arms or hands on a support portion of the exercise device adapted to receive arms or hands of a person and wherein the support portion can tilt in a side tilting position, a forward tilting position, and a backward tilting position. In the second step 904, a game is executed on a display device. In the third step 906, the user tilts the support portion in response to a screen displayed on the display device.

The above used terms, including "attached," "connected," "secured," and the like are used interchangeably. In addition, while certain embodiments have been described to include a first element as being "coupled" (or "attached," "connected," "fastened," etc.) to a second element, the first element may be directly coupled to the second element or may be indirectly coupled to the second element via a third element.

What is claimed is:

1. A device, comprising:

a support portion comprising a first portion on a first end of the support portion and a second portion on a second end of the support portion, the first portion being sized and configured to receive at least one of an elbow or a forearm of a user, wherein the support portion is trapezoidal in shape;

a stationary base that is stationary with respect to a support surface when the device is placed on the support surface;

a destabilizer operatively coupled to the support portion and the stationary base to allow twisting movements, tilting forward, tilting backward, and tilting side to side.

2. The device of claim 1, wherein the first portion comprises at least one padded section that receives the at least one of the elbow or the forearm.

3. The device of claim 2, wherein the support portion comprises a first side and a second side;

the first side and the second side extend from the first portion to the second portion;

the at least one padded section comprises a first padded section on the first side and a second padded section on the second side;

the first padded section receives a first elbow of the at least one of the elbow or the forearm; and the second padded section receives a second elbow of the at least one of the elbow or the forearm.

4. The device of claim 3, wherein the support portion comprises a recess sized to fit an electronic device; and the recess is between the first padded section and the second padded section.

5. The device of claim 4, wherein the recess is T-shaped;

the recess is recessed relative to a surface of the support portion; and the recess configured to be between the first elbow and the second elbow.

6. The device of claim 2, wherein the at least one padded section receives one of the at least one of the elbow or the forearm.

7. The device of claim 2, wherein the support portion moves relative to the stationary base responsive to the at least one of the elbow or the forearm exerting force upon the support portion.

8. The device of claim 2, wherein at location of the support portion at which the destabilizer is operatively coupled to the support portion is offset from a center of the support portion.

9. The device of claim 1, wherein the stationary base comprises a first end and a second end opposite to the first end;

the first end receives at least a portion of the destabilizer; and the first end is narrower than the second end.

10. The device of claim 9, wherein the stationary base comprises an inner wall at the first end;

the inner wall forms a socket; and the socket receives the at least the portion of the destabilizer.

11. The device of claim 10, wherein the destabilizer pivots the support portion in any direction by rotating within the socket.

12. The device of claim 9, wherein the first end and the second end have circular shapes;

the stationary base comprises a side wall extending from the first end to the second end; and the side wall is curved inward.

13. The device of claim 1, wherein the first portion and the second portion are coplanar.

14. The device of claim 1, wherein the destabilizer is a pivot ball.

15. The device of claim 1, wherein the stationary base has a conic shape.

16. The device of claim 1, wherein the destabilizer is operatively coupled to the support portion and the stationary base along an axis;

the destabilizer is between the support portion and the stationary base;

responsive to force exerted to the support portion by the user, the support portion rotates around the axis.

17. The device of claim 1, wherein responsive to force exerted to the support portion by at least one of the elbow or the forearm of the user, the support portion moves relative to the stationary base about the destabilizer.

18. A device, comprising:

a support portion comprising a first portion on a first end of the support portion and a second portion on a second end of the support portion, the first portion being padded and sized and configured to receive at least one of 1) two elbows or 2) two forearms of a user, and containing a recess sized to receive a display device;

a stationary base that is stationary with respect to a support surface when the device is placed on the support surface and has a conic shape; and a pivot ball operatively coupled to the support portion and the stationary base to allow twisting movements, tilting forward, tilting backward, and tilting side to side.

* * * * *